United States Patent [19]

Itoh et al.

[11] Patent Number: 5,016,430

[45] Date of Patent: May 21, 1991

[54] CRIMPING APPARATUS USED IN WRAPPING CYLINDRICAL OBJECTS

[75] Inventors: Kiyochika Itoh, Tokyo; Toshi Doyoshita, Komatsu, both of Japan

[73] Assignee: Tokyo Winder Co., Ltd., Tokyo, Japan

[21] Appl. No.: 477,259

[22] Filed: Feb. 7, 1990

[30] Foreign Application Priority Data

| | | | |
|---|---|---|---|
| Feb. 8, 1989 | [JP] | Japan | 1-29245 |
| Feb. 8, 1989 | [JP] | Japan | 1-29247 |
| Sep. 12, 1989 | [JP] | Japan | 1-236615 |

[51] Int. Cl.[5] ..... B65B 7/14; B65B 11/54

[52] U.S. Cl. ..... 53/370.2; 53/211

[58] Field of Search ..... 53/211, 378, 379, 380

[56] References Cited

U.S. PATENT DOCUMENTS

| | | | |
|---|---|---|---|
| 2,066,414 | 1/1937 | Milmoe | 53/380 |
| 2,803,935 | 8/1957 | Gibson | 53/380 |
| 4,184,307 | 1/1980 | Kataoka | 53/380 |
| 4,524,562 | 6/1985 | Yagi | 53/378 X |
| 4,845,919 | 7/1989 | Fujii | 53/380 |

FOREIGN PATENT DOCUMENTS

| | | | |
|---|---|---|---|
| 381575 | 5/1973 | U.S.S.R. | 53/378 |

*Primary Examiner*—John Sipos

*Attorney, Agent, or Firm*—Michael N. Meller

[57] ABSTRACT

The present invention relates to a crimping apparatus for drawing up and closing the ends of a wrapping material applied to a cylindrical object which can reliably apply a uniform and visually appealing crimping to the ends of the object to be wrapped, and is not limited to small cylindrical objects. The present invention includes a paper folding mechanism, whereby an extended portion of wrapping paper extending beyond the end surfaces of the cylindrical object can be folded inward against the respective end surfaces, and further includes an internal support mechanism whereby the above mentioned extended portions can be supported from within by their internal surfaces. Additionally, the crimping apparatus of the present invention includes a means to apply a sealing label to the crimped end of the cylindrical object.

8 Claims, 30 Drawing Sheets

CRIMPING APPARATUS USED IN WRAPPING CYLINDRICAL OBJECTS

FIELD OF THE INVENTION

The present invention relates to a crimping apparatus for drawing up and closing the ends of a wrapping material applied to a cylindrical object.

PRIOR ART

Generally, when it is desired to apply wrapping paper or other sheet form packaging material to a cylindrical shaped object, for example rolls of paper, film, and the like, a wrapping apparatus is employed which wraps the object by applying the wrapping material to the surface of the object which is parallel to its longitudinal axis, that is, the curved surface. In so doing, a wrapping material wider than the length of the object is often employed, and the wrapping material is caused to extend beyond both ends of the object. In this way, cylindrical shaped sections of the wrapping material are created protruding and extending beyond both ends of the object, which are then tucked in (crimped) against the end of the cylindrical object.

With prior art equipment for carrying out the above described crimping process, the objects to be wrapped have generally been limited to on the order of tens of mm. in diameter. A representative example of such a prior art crimping device is shown in FIGS. 34 and 35. In the illustrated prior art device, only one end surface 2 of the cylindrical object 1 to be wrapped is shown. A hollow tube 3 is provided at the central portion of the cylindrical object 1 in order to preserve its cylindrical shape. The wrapping paper 4 has cylindrical shaped extensions 5 protruding beyond each end surface 2 of the cylindrical object 1. Rollers 10, 10 support the cylindrical object 1 so that it can freely rotate. At the outer circumference of one or both of the cylindrical shaped extensions 5 of the wrapping paper 4, a plurality of pivot members 14 are provided in a ring configuration, mounted on hinges 12 so as to pivot freely in a plane containing both the pivot member 14 and the central longitudinal axis of the cylindrical object 1.

As indicated by the centrally pointing arrows in FIG. 34, the pivot members 14 travel inward from their peripheral most position as they are shown in FIGS. 34 and 35. As shown in FIGS. 36 and 37, as the pivot members 14 travel inward, a series of folded peaks 6 are formed, the apex of each folded peak 6 being located between an adjacent pair of pivot members 14. When the pivot members 14 reach their central most position, the end of each pivot member 14 opposite its hinge 12 is held against the end surface 2 of the cylindrical object 1 with one layer of the wrapping paper intervening. Due to the relative motion of the rotating cylindrical object 1 and the non-rotating pivot members 14, the troughs between adjacent pairs of folded peaks 6 which are held against the end surface 2 by the ends of the non-moving pivot members 14 are caused to travel with the rotation of the cylindrical object 1 and thus end up being folded under, and crimped state shown in FIG. 38 is thereby achieved. At this point, ordinarily an adhesive label or the like is affixed to the central portion of the crimped ends to close them and hold them in their crimped state.

With such prior art crimping devices, while the apparatus is acceptable for cylindrical objects having a relatively small diameter, and for objects wrapped with relatively thin wrapping material, beyond certain limits for the diameter of the object and the thickness of the wrapping material, various problems arise as will be described later. When the diameter of the cylindrical object 1 is sufficiently small and the wrapping paper 4 is sufficiently thin, then the apex B of each folded peak 6, and the intervening troughs A are neatly formed as described above. This is due to the fact that when the wrapping paper 4 is sufficiently thin, the cylindrical shaped extensions 5 are relatively locally pliable in response to the action of the pivot members 14, whereas when the diameter of the cylindrical object 1 is sufficiently small, it retains a certain degree of rigidity and its shape as a whole tends to be preserved. Even if the apex B of each folded peak 6, and the intervening troughs A are less than perfectly formed as described above, because each folded peak 6 is small, such imperfections are not particularly conspicuous in the final product, and are often completely covered by the above mentioned adhesive label.

However, when the diameter of the cylindrical object 1 is large, simply tucking in the cylindrical shaped extensions 5 with the pivot members 14 as described above may give results which are undesirable. In such a case, because the cylindrical shaped extensions 5 must be correspondingly long, the cylindrical shaped extensions 5 become less rigid as a whole, and accordingly, the most distal portions tend to droop. Furthermore, to the extent that the wrapping paper 4 is thick, the local rigidity or resistance of the cylindrical shaped extensions 5 in response to the action of the pivot members 14 increases, and accordingly, rather than forming the above described apices B, the portions of the cylindrical shaped extensions 5 between adjacent pivot members 14 tend to collapse inward. Further, when the diameter of the cylindrical object 1 is large, because the folded peaks 6 that are formed tend to be large, any irregularities formed tend to be quite noticeable. Such irregularities cannot be obscured by merely placing an adhesive label or the like over the folds as was described above for smaller items.

At present, hand labor is often employed for dealing with cylindrical objects 1 of a large diameter and it has thus become desirable to develop a device to mechanize the process. In the manufacture of materials supplied on rolls, for example paper, up to the final steps of packaging, the process is largely automated and highly efficient. It is therefore obvious that a final manual step is undesirable in regard to manufacturing efficiency, and that an efficient means to automate the final packaging steps would be of great value.

SUMMARY OF THE INVENTION

In consideration of the points discussed above, it has become desirable to provide a crimping apparatus used in wrapping cylindrical objects which is efficient, can reliably apply a uniform and visually appealing crimping to the ends of the object to be wrapped, and is not limited to small cylindrical objects. Accordingly, it is an object of the present invention to provide a crimping apparatus used in wrapping cylindrical objects, in which the crimping apparatus is provided with a paper folding mechanism, whereby the above mentioned extended portions of the wrapping paper extending beyond the end surfaces of the cylindrical object can be folded inward against their respective end surfaces, and in which the crimping apparatus is further provided with an internal support mechanism which is freely advancable and retractable into the interior spaces defined by the above mentioned extended portions, in a direction parallel to the longitudinal axis of the cylindrical object, whereby at least when the above mentioned paper folding mechanism is applying an inward folding force, the above mentioned extended portions can be supported from within by their internal surfaces. With such a crimping apparatus, when the extended portions are folded inward by the above mentioned paper folding mechanism, by supporting the extended portions from within by the above mentioned internal support mechanism, the valley portions projecting radially inward and the peak portions projecting radially outward are neatly formed. In this way, regardless of the thickness of the wrapping material or the diameter of the cylindrical object, a uniform and visually appealing crimping can be applied to the ends of the object to be wrapped.

In the first preferred embodiment of the present invention, the above mentioned paper folding mechanism is equipped with a plurality of movable plates provided at equally spaced intervals in a ring formation, in which the above mentioned movable plates are able to move inward in concert toward their central point, thereby applying a folding force against the external surface of an extended portion of the wrapping paper, the movement of each movable plate being along a line deviating from the radial orientation by a predetermined angle. With such a construction, the folded peaks are formed somewhat deviated from exactly a radial orientation with respect to the end surfaces of the cylindrical object. In this way, an improved external appearance is obtained and the size of the central aperture is reduced.

Further, the paper folding mechanism described in the first preferred embodiment of the present invention includes a clasping mechanism, whereby the folded peaks formed as described above are clasped on each side and are thereby flattened into the form of a single leaf. In this way, the folding of the peaks against the end surfaces of the cylindrical object can be more easily and neatly carried out and the external appearance of the final product is further improved.

Further, the crimping apparatus described in the first preferred embodiment of the present invention includes a pressure applying unit which is freely advancable and retractable in a direction parallel to the longitudinal axis of the cylindrical object, whereby a label, seal, or similar item can be affixed over and surrounding the central aperture formed after the folded peaks and flattened and folded against the ends of the cylindrical object. By providing the above mentioned pressure applying unit, the neatly crimped state of the ends of the wrapping material can be maintained and the package can be attractively sealed.

BRIEF DESCRIPTION OF THE OF THE DRAWINGS

DETAILED DESCRIPTION OF THE PREFERRED EMBODIMENTS OF THE PRESENT INVENTION

Figure 1:
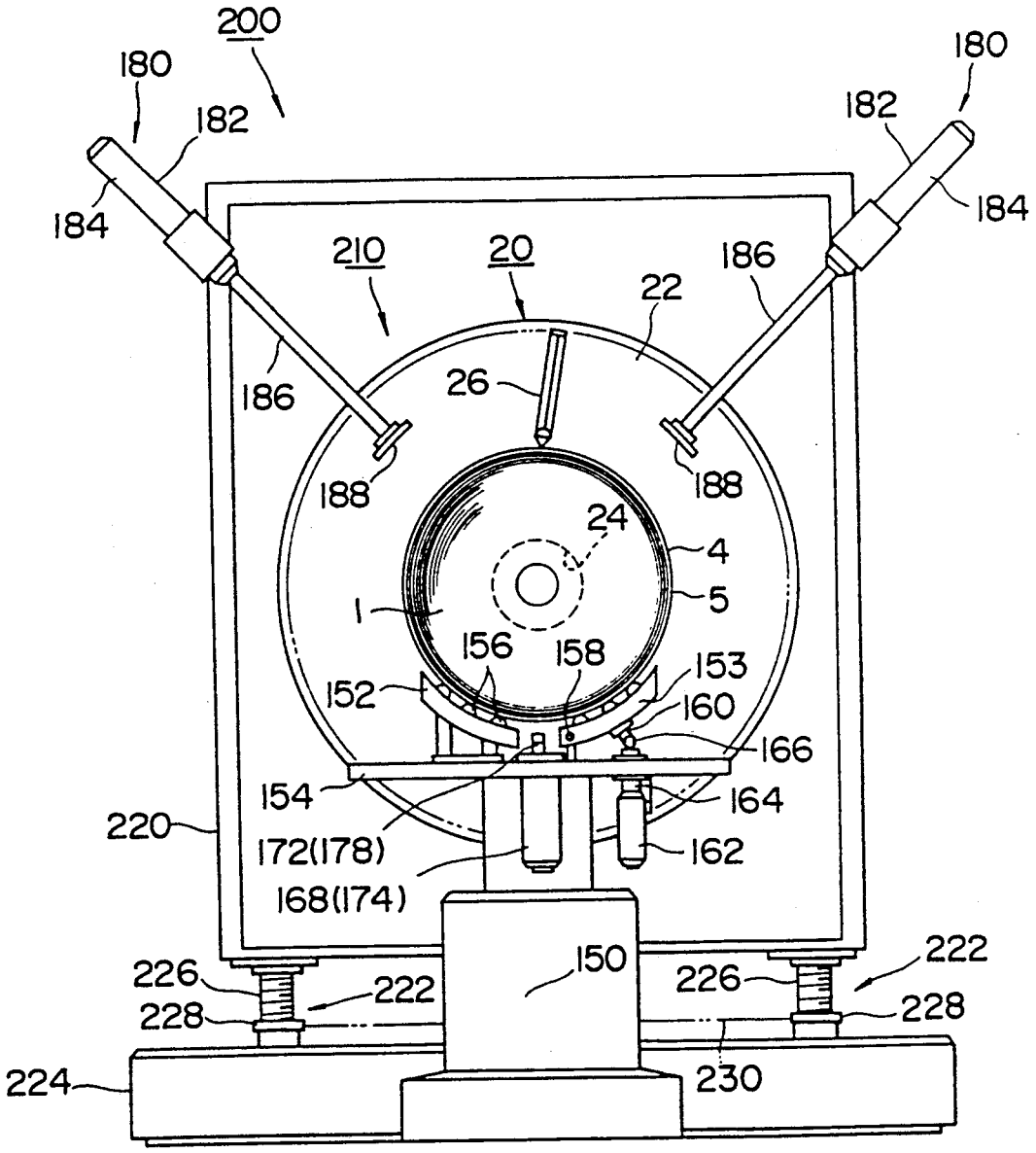
FIG. 1 is a plan view of one example of the crimping apparatus of the present invention.

In the following sections, the preferred embodiments of the present invention will be described with reference to the drawing.

Figure 2:
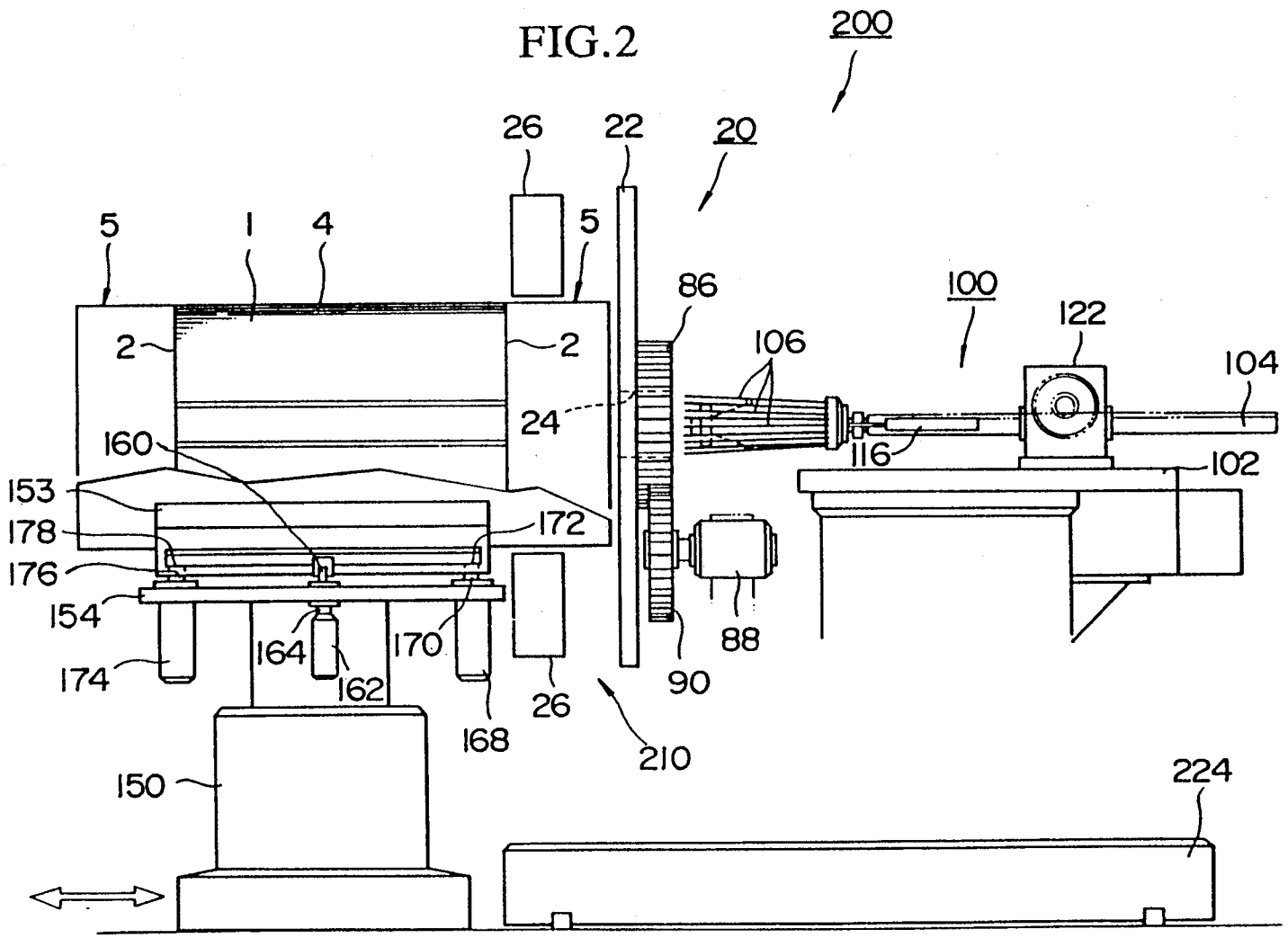
FIG. 2 is a side view of the crimping apparatus shown in FIG. 1.
Figure 3:
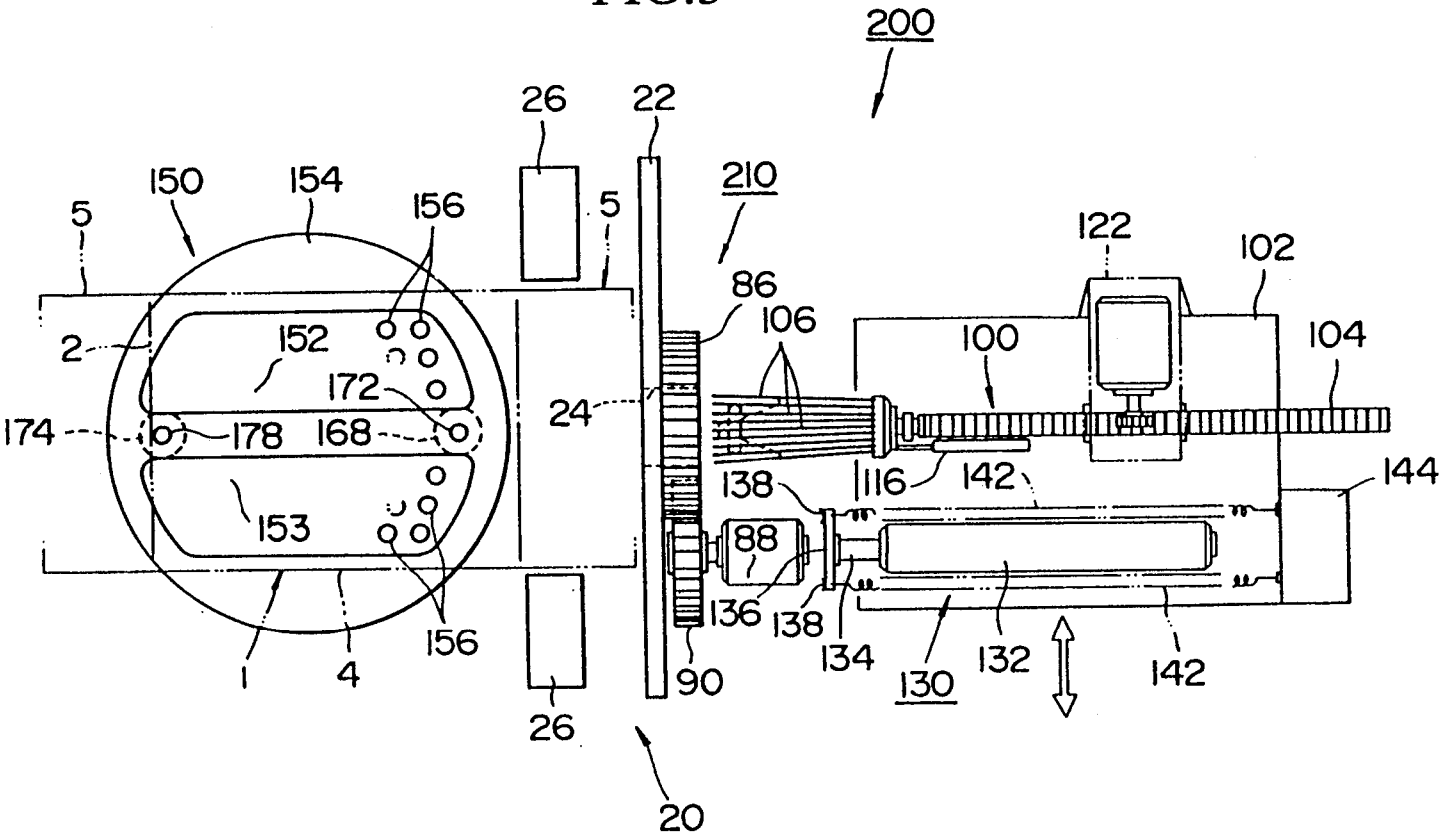
FIG. 3 is an overhead view of the crimping apparatus shown in FIG. 1.

FIGS. 1, 2, and 3 are a plan view, side view, and overhead view respectively of the roll wrapping crimping apparatus (hereafter referred to as crimping apparatus) 200 of the present invention in its entirely.

The crimping apparatus 200 of the present invention operates upon a cylindrical object 1 which has been wrapped with wrapping paper 4 which has been rolled around the circumference of the cylindrical object 1 so that the wrapping paper 4 is caused to extend beyond at least one end of the cylindrical object 1, the extended portion 5 thereby taking the form of a hollow cylinder.

With the crimping apparatus 200 of the present preferred embodiment, a paper folding mechanism 20 is included which folds the extended portion 5 of the wrapping paper 4 inward against the respective end surface 2 of the cylindrical object 1. Additionally, an internal support mechanism 100 is provided which is freely movable along the internal surface of the extended portion 5 of the wrapping paper 4 in an orientation parallel to the longitudinal axis of the cylindrical object 1, by which means at least during when the above mentioned folding mechanism 20 is applying an inward folding force, the extended portion 5 is supported along its internal surface. The above mentioned internal support mechanism 100 is provided at the rear surface of a main crimping unit 210 which includes the previously mentioned paper folding mechanism 20.

Additionally, with the crimping apparatus 200 of the present preferred embodiment, at the front surface of the main crimping unit 210, a roll support stand 150 is provided to support the wrapped cylindrical object 1. Also, as shown in FIG. 1, the main crimping unit 210 is attached to a frame 220. The above mentioned frame 220 is provided with a raising and lowering means 222 at its lower aspect. The above mentioned raising and lowering means 222 is provided with a plurality of ball screws 226 used for height adjustment intervening between frame 220 and a base 224. Each of the above mentioned ball screws 226 is coaxially provided with a sprocket 228. The above mentioned sprockets 228 are interconnected with an endless chain 230 which is in turn driven by a motor (not shown in the drawing), whereby the sprockets 228 of the ball screws 226 are driven in unison, thereby permitting the height of frame 220 to be adjusted, thus allowing adjustment of the level of main crimping unit 210.

In the following section, paper folding mechanism 20 will be described with reference to FIGS. 4 to 7.

Disk shaped support plate 22, which is oriented in approximately a vertical plane, supports a movable plates 26, a drive unit for movable plates 26, as well as other components, all of which are to be described later. The above mentioned disk shaped support plate 22 is in turn supported by frame 220, and is of a diameter of approximately one meter in the present preferred embodiment. Also, at the central portion of this disk shaped support plate 22, an opening 24 is formed through which the internal support mechanism 100 to be later described in detail can pass. On one surface of the disk shaped support plate 22, that is the surface which faces the end surface 2, a plurality of movable plates 26 are attached, each via a respective delivery mechanism 30. In the case of the present preferred embodiment, twelve of the above mentioned movable plates 26 are provided, however, the number is in no way so limited.

Figure 4:
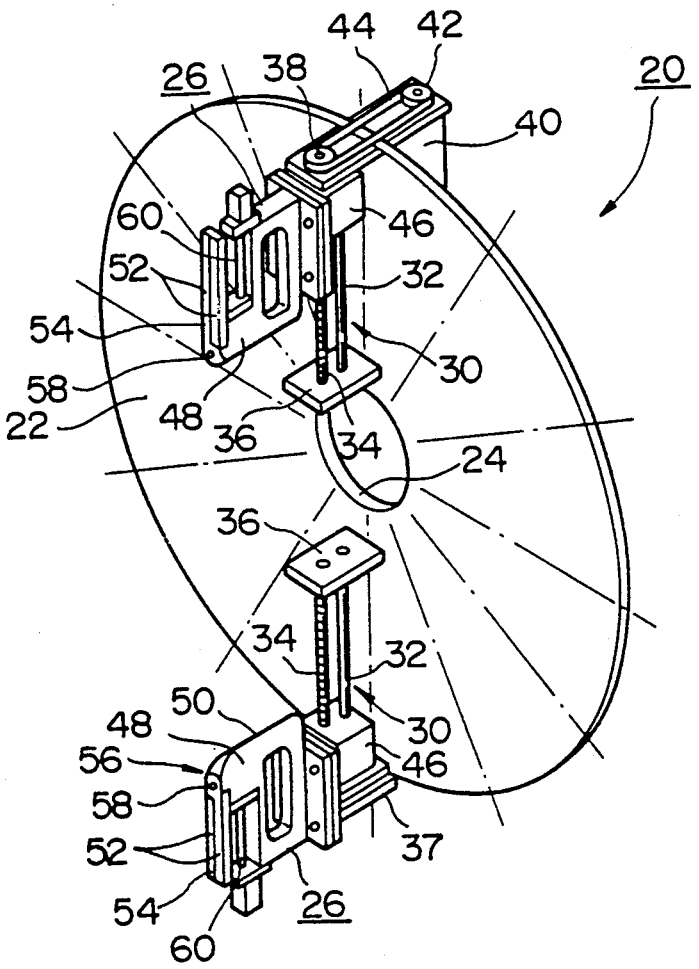
FIG. 4 is an oblique view of the paper folding mechanism provided as part of the crimping apparatus shown in FIG. 1.
Figure 5:
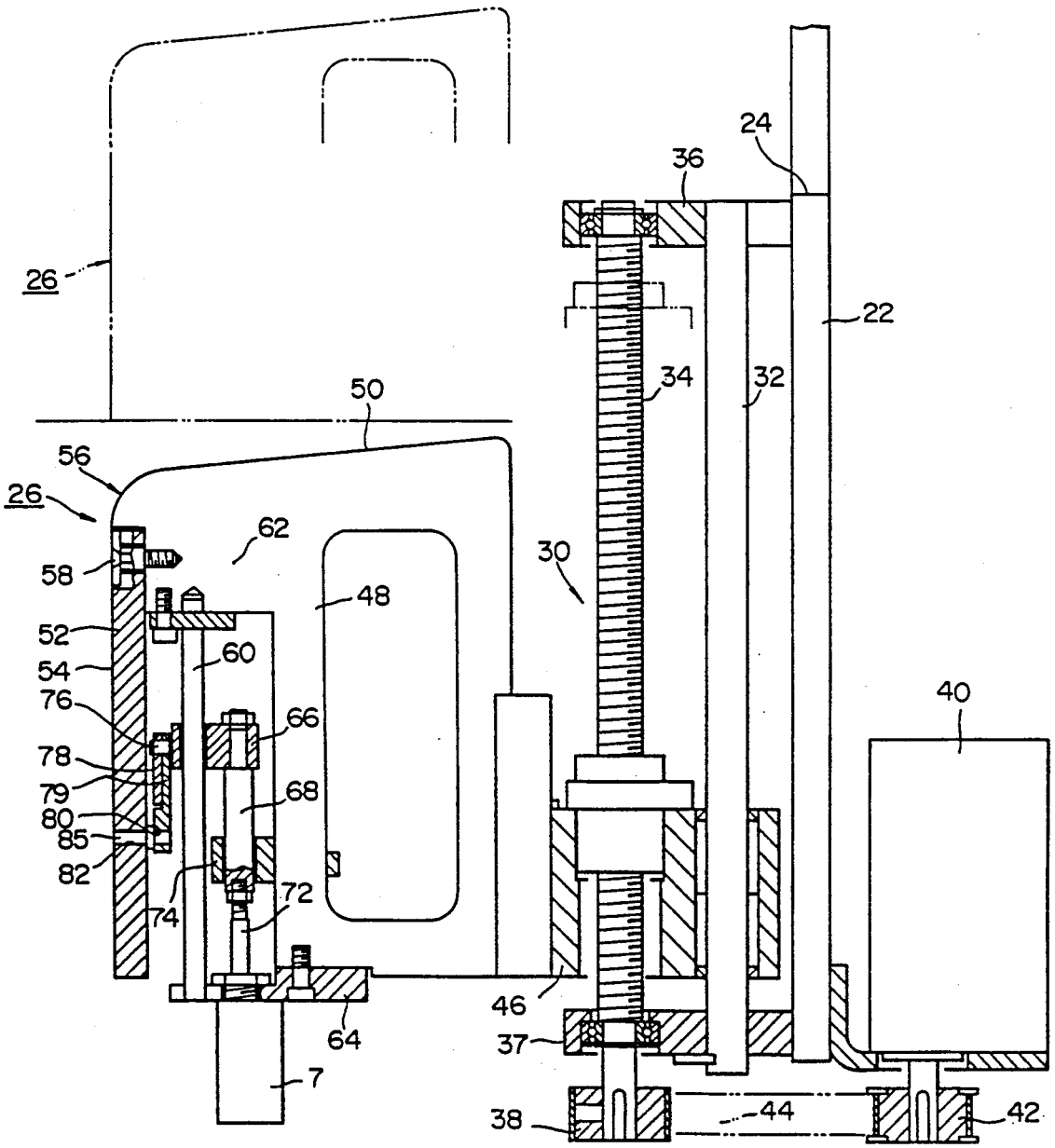
FIG. 5 is an enlarged side view of a portion of the paper folding mechanism shown in FIG. 4.
Figure 6:
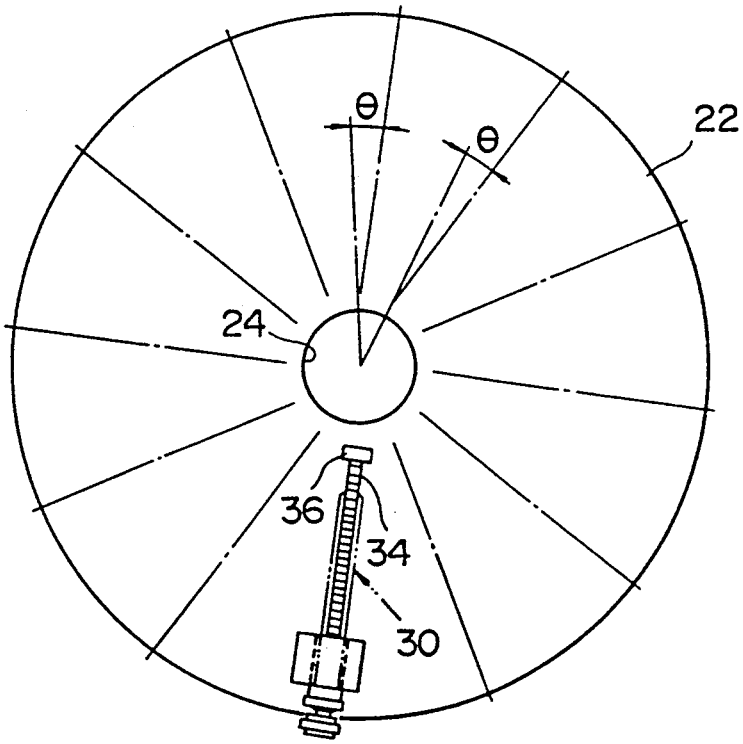
FIG. 6 is a simplified plan view of a portion of the paper folding mechanism shown in FIG. 4.

As shown in FIGS. 4 and 5, the above mentioned traveling mechanisms 30 are each made up of a guide rod 32, a ball screw 34 provided parallel to the guide rod 32, as well as support units 36, 37 to support the ends of both the guide rod 32 and ball screw 34. The above mentioned twelve guide rods 32 and ball screws 34 each extend from the peripheral potion of disk shaped support plate 22 centrally to the vicinity of its central most portion in an approximately radial direction, and are equally spaced one from the other. Thus, the twelve guide rods 32 and ball screws 34 are arranged in a radial spoke-like array, each set of guide rod 32 and ball screw 34 forming an angle of 30° with its neighboring sets of guide rod 32 and ball screw 34 on either side. As mentioned above, the guide rods 32 and ball screws 34 are aligned on disk shaped support plate 22 in an approximately radial direction. However, there is some deviation from exactly a radial orientation, and in the case of the present preferred embodiment, the guide rods 32 and ball screws 34 deviate by an angle $\theta$ of 10° from exact a radial orientation. At the peripheral end of the above mentioned ball screws 34, timing pulleys 38 are provided. In the vicinity of the peripheral portion of the side of disk shaped support plate 22 opposite guide rods 32 and ball screws 34 (rear surface), twelve servo motors 40 corresponding to the above described guide rods 32 are provided, also spaced at equal intervals one from the other. The output shaft of each servo motor 40 is provided with a timing pulley 42 which is connected with the corresponding previously described timing pulley 38 provided on the corresponding ball screw 34 via a timing belt 44. In order to retain the previously mentioned movable plates 26, each delivery mechanism 30 is provided with a movable base seat 46 which is threaded over the corresponding ball screw 34 and slides freely over the corresponding guide rod 32.

The previously mentioned movable plates 26 are each mounted on the corresponding movable base seat 46, and in the present preferred embodiment, are made up of a movable body 48 and two spreaders (clasping mechanism) 52 provided on the front edge (opposite edge from disk shaped support plate 22) of movable body 48. The inner (central) edge of each movable body 48 forms a folding edge 50 by which means when the movable plates 26 advance against the external surface of the extended portion 5 of the wrapping paper 4, the folding edge 50 is brought into contact with the external surface of the extended portion 5 and causes it to fold inward, thereby forming the previously described folded peaks. When the movable plates 26 advance against the external surface of the extended portion 5 of the wrapping paper 4, the previously mentioned spreaders 52 press against the end surface 2 of the cylindrical object 1. Accordingly, the leading edge of the spreaders 52 form an end surface pressure face 54. The above mentioned folding edge 50 is formed so that its leading edge forms an acute angle, and further as shown in FIG. 5, so that it inclines toward the center from its front end (opposite end from disk shaped support plate 22) to its rear end (end adjacent to disk shaped support plate 22). Also, the junction of folding edge 50 and end surface pressure face 54 is gently curved to form curved face 56.

Figure 7:
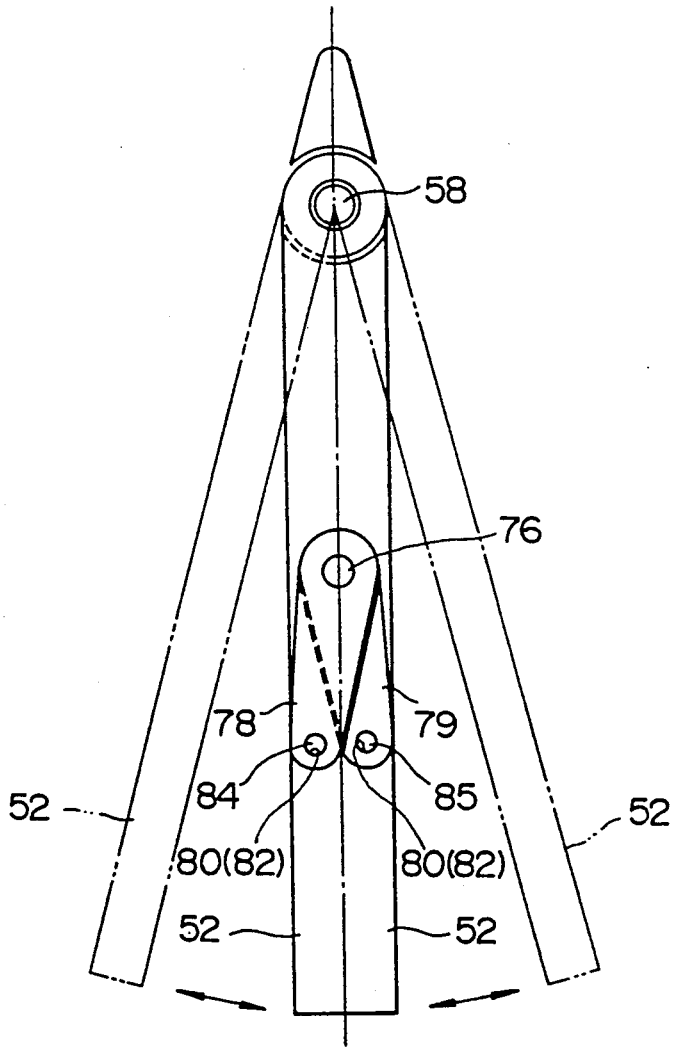
FIG. 7 is a plan view of one of the moving body components of the paper folding mechanism shown in FIG. 4.

Each pair of the above mentioned spreaders 52 are provided in a parallel orientation with respect to the corresponding guide rod 32 and ball screw 34, and are at least as long as the displacement of the movable plates 26. Also, the ends of each pair of the above mentioned spreaders 52 facing centrally are fastened with a pin 58 which is perpendicular with respect to disk shaped support plate 22. At the sides of each pair of spreaders 52 facing towards disk shaped support plate 22, a second guide rod 60 is provided fixed on movable body 48 in a parallel relationship with the corresponding guide rod 32 and ball screw 34. The above mentioned pin 58 is fixed in an extending portion 62 of movable body 48 which extends away from disk shaped support plate 22. The above mentioned second guide rod 60 is mounted between extending portion 62 of movable body 48 and a support plate 64 which is fixed on the peripheral end of movable body 48. A sliding block 66 is provided on second guide rod 60. The above mentioned sliding block 66 is provided on second guide rod 60. Via a connector rod 68 which extends toward support plate 64 parallel to second guide rod 60, sliding block 66 is connected with the end of a rod 72 provided on air cylinder 70. As seen in FIG. 5, bearing 46 is fixed on movable body 48, through which connector rod 68 is supported, free to slide in its axial direction. The above mentioned air cylinder 70 is quite small, and is referred to as a pin cylinder. The above mentioned air cylinder 70 is mounted on support plate 64, and through the action of a pressurized air control device which is not shown in the drawings, via the previously mentioned connector rod 68, is able to draw sliding block 66 toward support plate 64. Furthermore, on the side of sliding block 66 facing spreaders 52, a second pin 76 is provided jutting away from and perpendicular to disk shaped support plate 22, similar to pin 58. As shown in FIG. 7, the ends of two links 78, 79 are attached so as to pivot freely thereabout. At the opposite ends of each of the above mentioned links 78, 79, through holes 80 are formed. Similarly, through holes 82 are formed at approximately a mid-shaft position in each of spreaders 52, and via third pins 84, 85, each through hole 80 is connected with the corresponding through hole 82, whereby the an end of each link 78, 79 is linked with a respective spreader 52.

As shown in FIGS. 2 and 3, a center gear 86 is attached on the rear side of disk shaped support plate 22 surrounding the previously described opening 24. The center gear 86 engages with a drive gear 90 which is driven by motor 88, whereby disk shaped support plate 22 is in turn driven by motor 88.

With the crimping apparatus 200 of the present invention, an internal support mechanism 100 is provided with the paper folding mechanism 20 constructed as described above. In the following section, this internal support mechanism 100 will be described in detail.

The internal support mechanism 100 is freely movable along the internal surface of the extended portion 5 of the wrapping paper 4 in an orientation parallel to the longitudinal axis of the cylindrical object 1, and when the above mentioned movable plates 26 are applying an inward folding force, the extended portion 5 is supported by internal support mechanism 100 along its internal surface.

As shown in FIGS. 2 and 3, the internal support mechanism 100 is provided on a movable stand 102 at the rear of disk shaped support plate 22, approximately opposite opening 24. The principal structure of internal support mechanism 100 is a plurality of support spokes 106 in a radial array provided on the end of an elongated rack rod 104, on the upper surface of which a rack gear is formed. The number of the above mentioned support spokes 106 is the present preferred embodiment is twelve, corresponding with the number of previously described movable plates 26.

Figure 8:
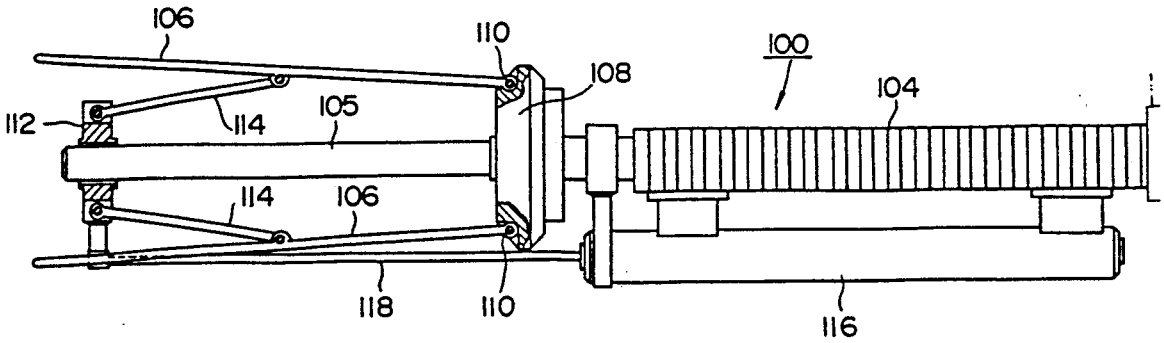
FIG. 8 is an overhead view of the internal support mechanism provided as part of the crimping apparatus shown in FIG. 3.
Figure 9:
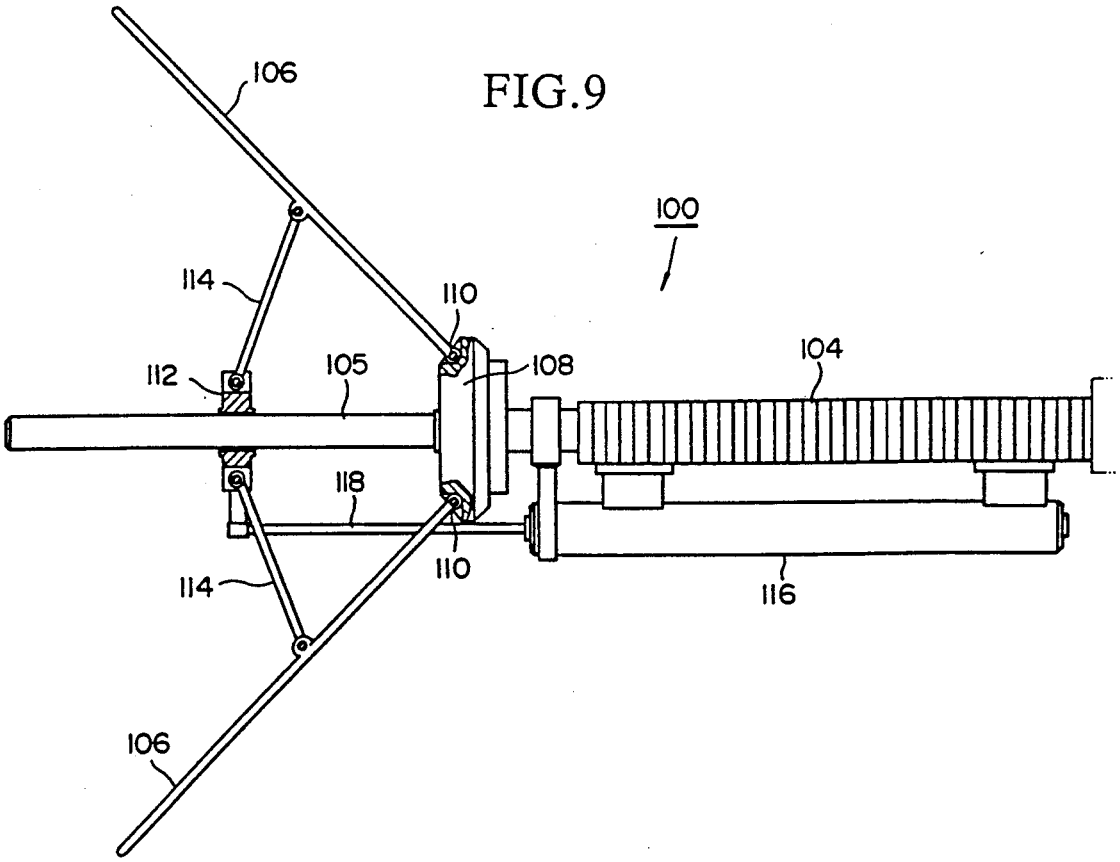
FIG. 9 is an overhead view showing the operating position of the internal support mechanism shown in FIG. 8.
Figure 10:
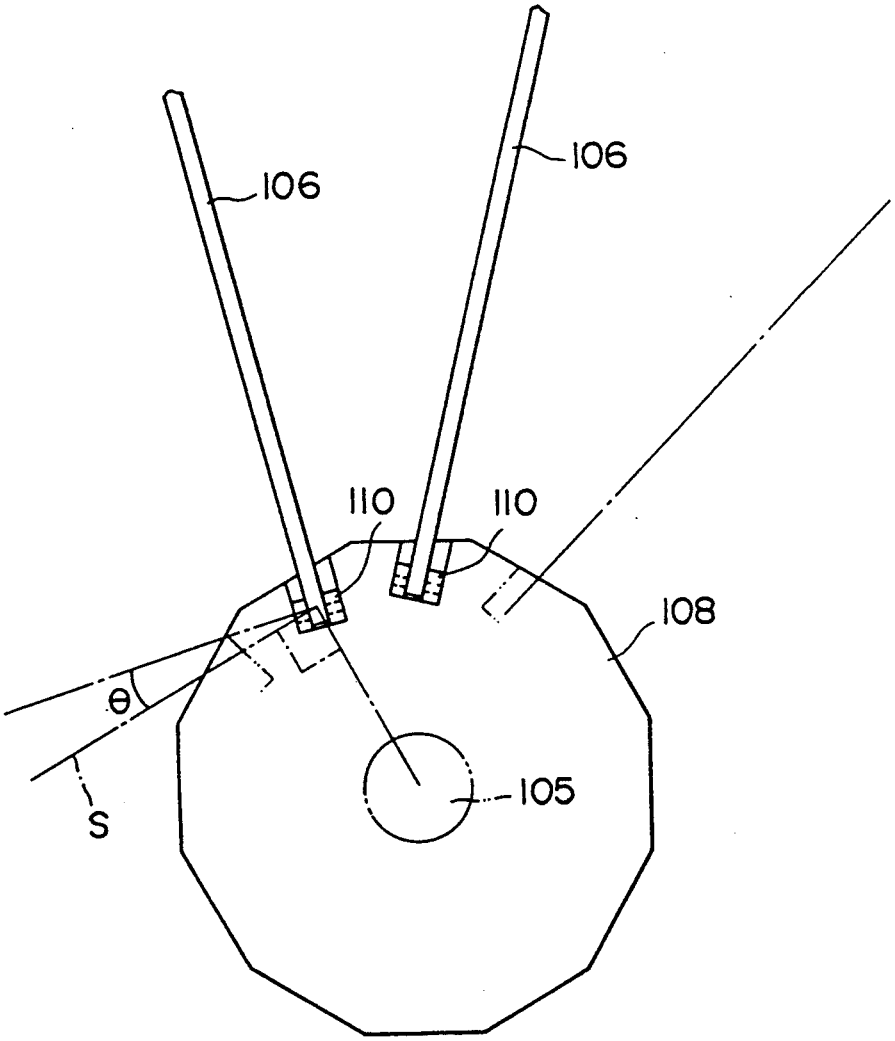
FIG. 10 is a simplified plan view showing a portion of the internal support mechanism shown in FIG. 9.
Figure 12:
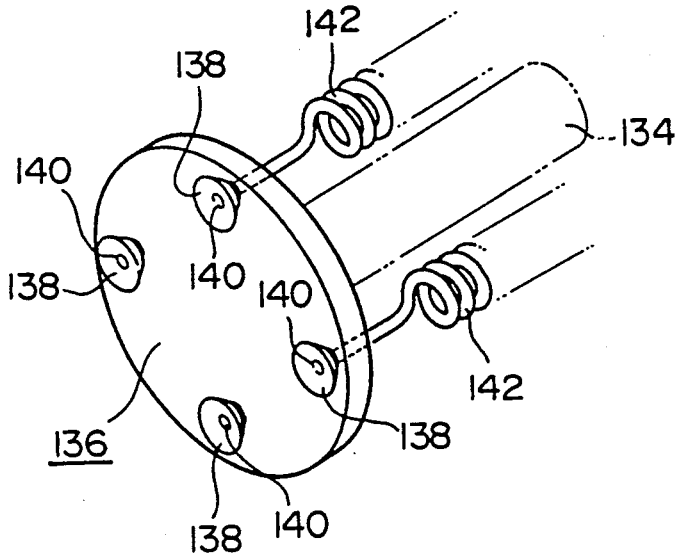
FIG. 12 is an enlarged oblique view of a portion of a pressure plate drive mechanism for the crimping apparatus shown in FIG. 3.

As shown in FIG. 8, a portion of rack rod 104 up to the proximal end is of reduced diameter, forming a guide rod 105. At the beginning of the reduced diameter section forming the guide rod 105, a base end support unit 108 is provided, on which one end (base end) of each support spoke 106 is attached by a pin 110 so as to be freely pivotable. A sliding band 112 is provided on the shaft of guide rod 105, so as to slide freely along the length guide rod 105, the reduced diameter portion of rack rod 104. To the sliding band 112, twelve links 114 are connected via pins so as to pivot freely. The opposite end of each of the above mentioned twelve links 114 is connected with a corresponding support spoke 106 by a pin at approximately its mid-shaft position, again so as to pivot freely. Furthermore, an extending-retracting rod 118 of a support spoke drive air cylinder 116 which is provided on rack rod 104 rearward from base end support unit 108 is connected with sliding band 112. As shown in FIG. 9, when extending-retracting rod 118 is caused to retract through the action of support spoke drive air cylinder 116, the array of support spokes 106 open in an umbrella like fashion. As can be seen from FIG. 10, each of the above mentioned pins 110 with which the base of a corresponding support spoke 106 is supported, deviates from a line S perpendicular to the radii of base end support unit 108 by an angle given by $\theta$. The above mentioned angle $\theta$ corresponds to and is the same as the previously described angle $\theta$ by which the movable plates 26 deviate from exact a radial orientation with respect to disk shaped support plate 22 (10° in the present preferred embodiment). Due to this fact, as shown in FIG. 10, each support spoke 106 opens and closes in an orientation deviating from the radial direction of base end support unit 108 by an angle given by $\theta$.

The previously mentioned rack rod 104 is driven in its axial direction by a rack rod driver mechanism 122 provided on movable stand 102. The above mentioned rack rod driver mechanism 122 is comprised of elements not shown in the drawings including a servo motor, speed reduction mechanism, and a pinion gear which engages the rack gear on rack rod 104. Due to the fact that rack rod 104 passes through rack rod driver mechanism 122, the rack rod driver mechanism 122 is used to support, as well as drive rack rod 104. The internal support mechanism 100 is thus comprised of the above mentioned rack rod 104, support spokes 106, support spoke drive air cylinder 116, and rack rod driver mechanism 122. Further, the above mentioned movable stand 102 is constructed so as to move in a horizontal plane in a direction parallel to the plane in which disk shaped support plate 22 lies, as shown by the arrows in FIG. 3.

Figure 11:
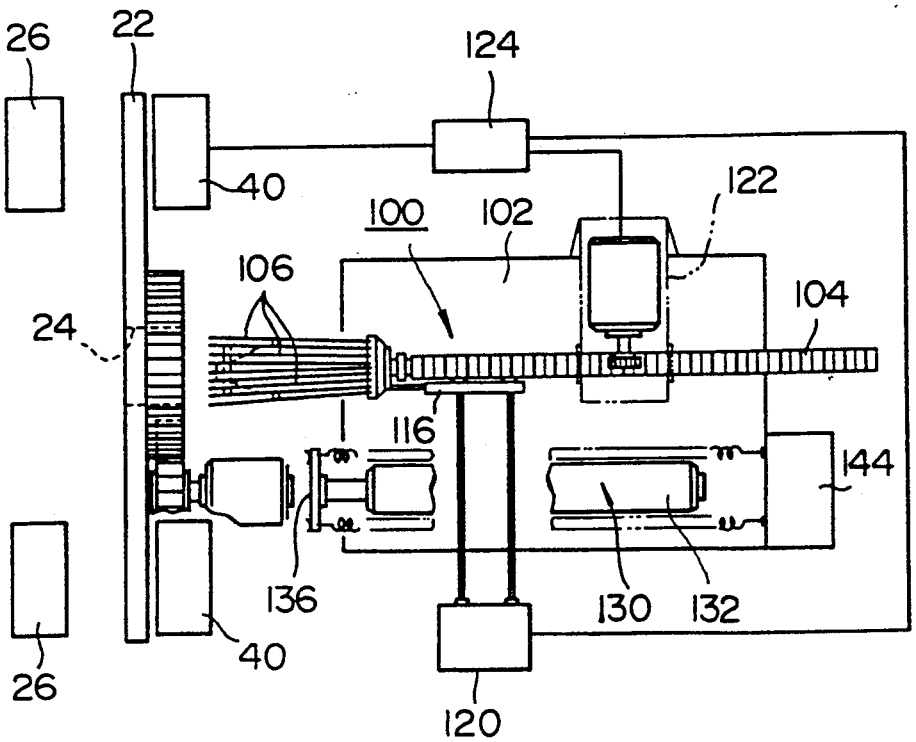
FIG. 11 is a schematic structural view of a control means for the internal support mechanism of the crimping apparatus shown in FIG. 3.

Concerning the above mentioned support spoke drive air cylinder 116 comprising a component of the internal support mechanism 100 of the present preferred embodiment of the present invention, as shown in FIG. 11, an application force maintenance device 120 is provided in order to maintain the force applied outward by the support spokes 106 at a constant value. The application force maintenance device 120 maintains the force applied by the support spokes 106 at a constant value by controlling the release of air pressure from support spoke drive air cylinder 116. In the present preferred embodiment, the applied pressure is maintained at 3.5 $kg/cm^2$.

Also, via the control means 124 shown in FIG. 11, rack rod driver mechanism 122 is electronically linked with the previously mentioned servo motors 40 which drive the movable plates 26. Through the above mentioned electronic linking, the return movement (left to right in FIG. 11) of the rack rod 104, and hence that of the support spokes 106 can be controlled based on the movement of movable plates 26. Furthermore, based on a signal from the control means 124, the application force maintenance device 120 also controls return movement of the rack rod 104.

Moreover, in the crimping apparatus 200 of the present preferred embodiment, as shown in FIG. 3, a pressure plate drive mechanism 130 is provided in alignment on the above mentioned movable stand 102 with the above mentioned internal support mechanism 100. The above mentioned pressure plate drive mechanism 130 is mainly comprised by an elongated air cylinder 132. As shown in FIG. 3, at the distal end of piston rod 134 of air cylinder 132, a disk shaped pressure plate (pressure applying unit) 136 is provided. When the above mentioned piston rod 134 is caused to extend, pressure plate 136 stops and fixes at a position projecting just beyond the forward portion of the movable plates 26 (that is, at the above mentioned end surface pressure faces 54 of the spreaders 52) of the main crimping unit 210 (paper folding mechanism 20). Further, on the forward face of pressure plate 136, four suction cups 138 are provided. Each of the four suction cups 138 has a hole 140 which penetrates as far as the rear surface of the suction cups 138. Where the above mentioned holes 140 exit at the rear mounting portion of each of the suction cups 138, the holes 140 each connect with one end of respective flexible coiled tubes 142. The opposite ends of the flexible coiled tubes 142 in turn connect with a vacuum device 144 provided at the rear portion of air cylinder 132.

As shown in figures, including FIG. 1, the above mentioned roll support stand 150 has receiving plates 152, 153 which are curved into the form of an arc. As shown in by the double headed arrow in FIG. 2, main crimping unit 210 can be moved in a direction corresponding to the longitudinal axis of the cylindrical object 1, thereby allowing the separating distance between the main crimping unit 210 and paper folding mechanism 20 to be freely adjusted. The above mentioned receiving plates 152, 153 are supported on the top of a support plate 154 which is provided in a horizontal orientation as right and left halves with respect to disk shaped support plate 22. As shown in FIG. 3, on the upper surfaces of the above mentioned receiving plates 152, 153, a plurality of spherical bearings 156 are provided. Further, of receiving plates 152, 153 which are formed as right and left halves, as shown in FIG. 1, receiving plate 153 is provided with a hinge 158 at its inner edge which allows the receiving plate 153 to pivot freely with respect to the axis defined between receiving plates 152, 153. From the lower surface of this receiving plate 153, plate 160 projects in an inferior direction. The lower end of plate 160 connects via a pin 166 with the distal end of the piston rod 164 of an air cylinder 162 which in mounted on and perpendicular to the above mentioned support plate 154. Thus, through the action of the above mentioned air cylinder 162, receiving plate 153 is pivotable about hinge 158. In this way, the loading and unloading of the cylindrical objects 1 to be wrapped is facilitated. Further, as shown in FIGS. 2 and 3, at the forward end of the opening formed between the inner edges of receiving plates 152, 153, a stopper 172 is provided at the terminal end of piston rod 170 of air cylinder 168 so as to be able to freely enter into and retract from the forward end of the opening formed between receiving plates 152, 153 through the action of air cylinder 168. Similarly, at the rear end of the opening formed between the inner edges of receiving plates 152, 153, a stopper 178 is provided at the terminal end of piston rod 176 of air cylinder 174 so as to be able to freely enter into and retract from the rear end of the opening formed between receiving plates 152, 153 through the action of air cylinder 174.

As seen in FIG. 1, two cylindrical object support units 180 are provided to maintain the cylindrical object 1 placed on roll support stand 150 in position during the crimping operation. These two cylindrical object support units 180 are formed from elongated air cylinders 182, the main bodies 184 of which are mounted on frame 220. The above mentioned cylindrical object support units 180 are provided somewhat in front of disk shaped support plate 22 (in FIG. 1, toward the viewer) with their longitudinal axes directed toward the central axis of disk shaped support plate 22. At the terminal ends of the piston rods 186 of air cylinders 182, suction cup like pressure applying elements 188 are provided.

In the following section, the operation of the above described crimping apparatus 200 will be described in detail with reference to FIGS. 13 through 33.

Step 1

Figure 13:
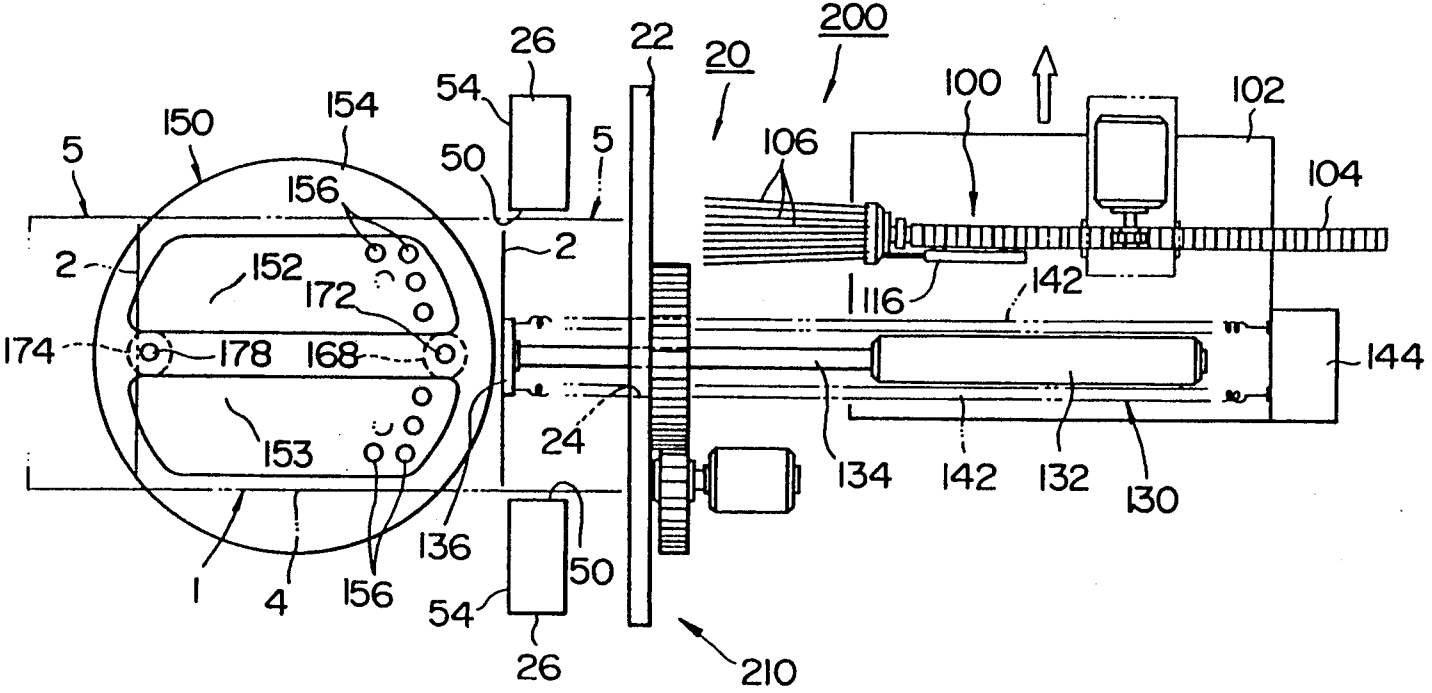
FIG. 13 is an overhead view showing the operation of the crimping apparatus shown in FIG. 3.
Figure 14:
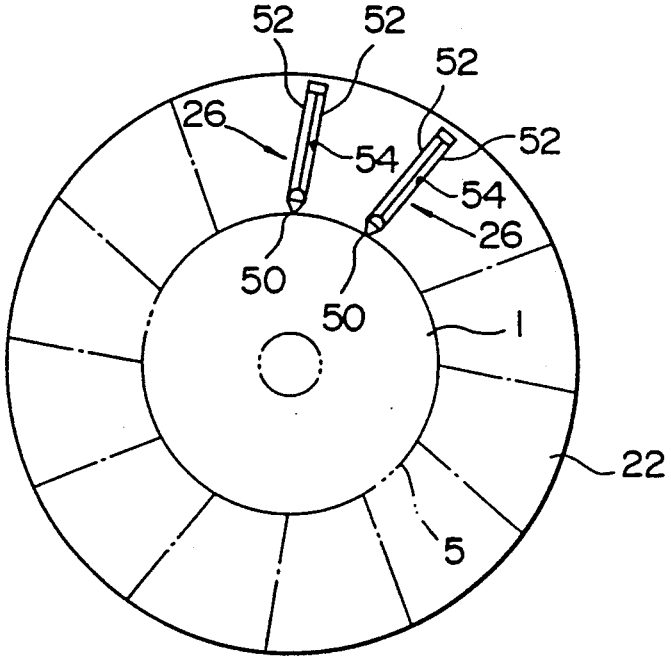
FIG. 14 is a plan view showing the operation of the paper folding mechanism shown in FIG. 4.

First of all, as shown in FIG. 13, the above mentioned pressure plate drive mechanism 130 provided on movable stand 102 is caused to move in the direction of the arrow in the drawing so as to oppose opening 24 in disk shaped support plate 22, so that the longitudinal axis of air cylinder 132 of pressure plate drive mechanism 130 is in alignment with the central axis of disk shaped support plate 22, and accordingly, with the central axis of the central opening 24 of disk shaped support plate 22. Then, the piston rod 134 of air cylinder 132 of pressure plate drive mechanism 130 is caused to extend. Piston rod 134 is thus caused to protrude from the front of disk shaped support plate 22 through opening 24. When the pressure plate 136 provided on the end of piston rod 134 reaches a position just beyond the forward portion of the movable plates 26, piston rod 134 stops and fixes. At this time, each of the movable plates 26 is positioned at the periphery of disk shaped support plate 22 as shown in FIG. 14.

Step 2

At this point, the cylindrical object 1 to be wrapped is located on the receiving plates 152, 153 of roll support stand 150. In the present preferred embodiment, the diameter of cylindrical object 1 is 500 mm.. Furthermore, the circumference of cylindrical object 1 has already been wrapped with wrapping paper 4.

Prior to placing the cylindrical object 1 on receiving plates 152, 153, by moving roll support stand 150 to a rearward position, it is caused to be separated from main crimping unit 210. When cylindrical object 1 is placed on receiving plates 152, 153, roll support stand 150 is caused to move toward main crimping unit 210. Because the roll support stand 150 is caused to stop after moving a certain distance, when roll support stand 150 stops, if the cylindrical object 1 is caused to press in a forward direction against disk shaped support plate 22, the front end surface 2 of cylindrical object 1 (the end of cylindrical object 1 opposing disk shaped support plate 22) stops in contact with the pressure plate 136 protruding from disk shaped support plate 22 through opening 24. The position where the front end surface 2 of cylindrical object 1 stops in contact with pressure plate 136 is prior to reaching a position adjacent to the end surface pressure faces 54 of the previously described spreaders 52. In this way, by virtue of the pressure plate 136, the position of cylindrical object 1 with respect to paper folding mechanism 20 (movable plates 26) can be set. At this point, as shown in FIG. 14, the extended portion 5 of the wrapping paper 4 projecting beyond the end surface 2 of cylindrical object 1 lies within the ring formation of the folding edges 50 of movable plates 26. By virtue of the previously described plurality of spherical bearings 156 provided on the upper surfaces of receiving plates 152, 153, movement of the cylindrical object 1 on receiving plates 152, 153 is exceedingly smooth.

Step 3

Figure 15:
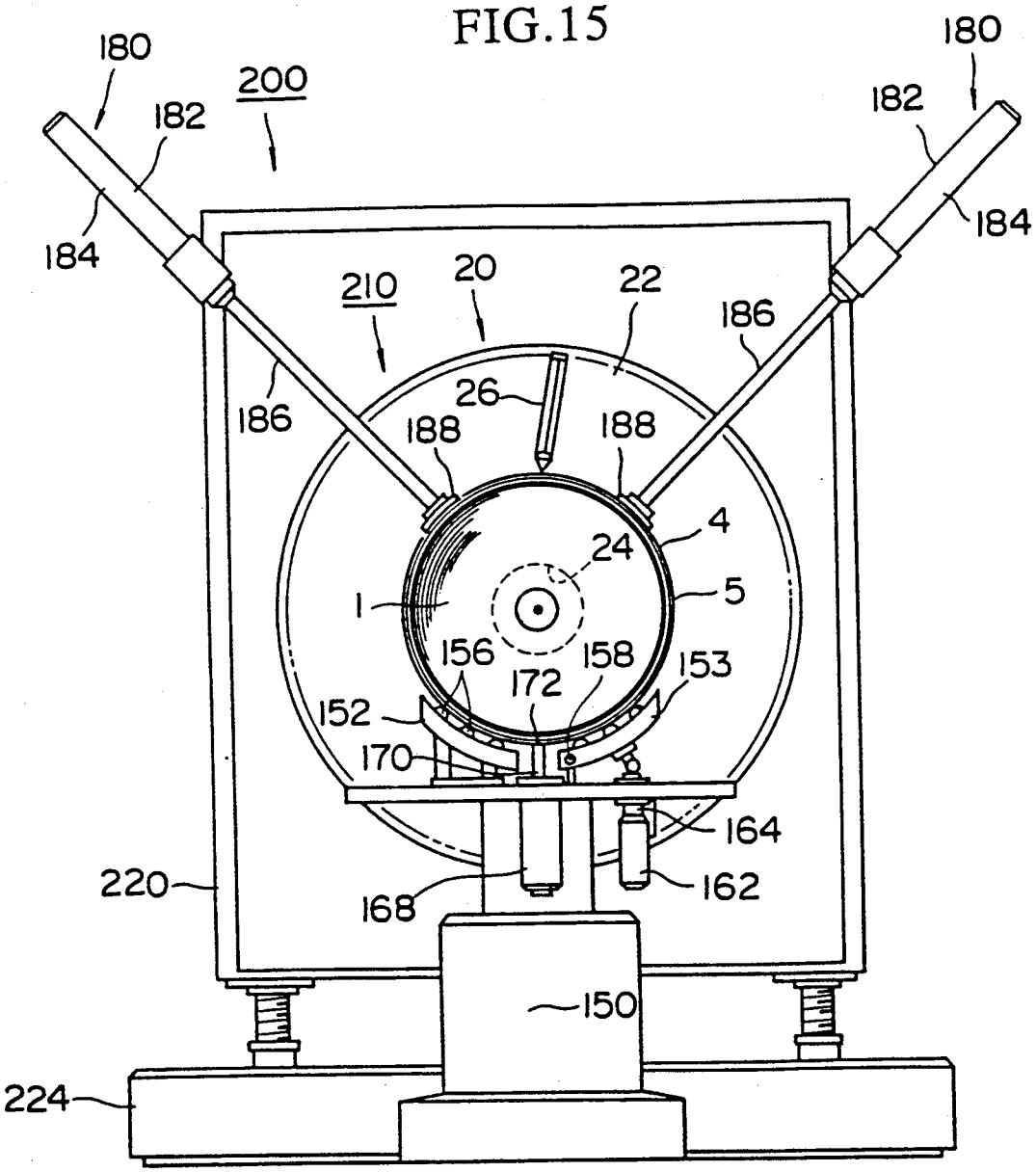
FIG. 15 is a plan view showing the operation of the crimping apparatus shown in FIG. 1.

At this point, of the pair of air cylinders 168, 174, the air cylinder closest to disk shaped support plate 22, that is, air cylinder 168 is caused to activate, and accordingly, as shown in FIG. 15, stopper 172 provided at the end of piston rod 170 of air cylinder 168 is caused to protrude between and above the two receiving plates 152, 153. At the same time, the air cylinders 182 of the two cylindrical object support units 180 mounted on frame 220 are caused to activate and their respective piston rods 186 then extend.

Through the above described operations, cylindrical object 1 is firmly supported on receiving plates 152, 153 and grasped at the three points formed by stopper 172 and the two pressure applying elements 188, one each provided at the end of each of the two piston rods 186.

Step 4

Figure 16:
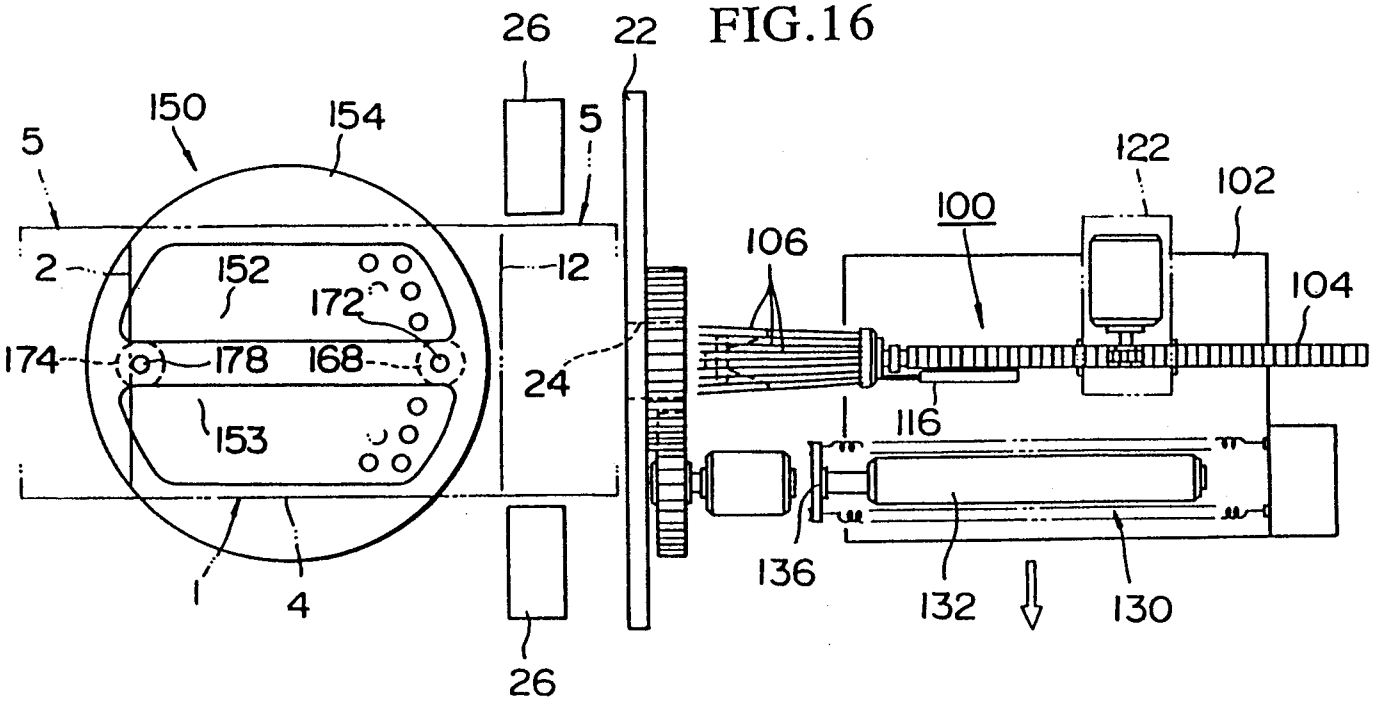
FIG. 16 is an overhead view showing the operation of the crimping apparatus shown in FIG. 3.

Next, with cylindrical object 1 thus positioned as described above, piston rod 134 of air cylinder 132 on which pressure plate 136 is provided is caused to retract, and then as shown in FIG. 16, movable stand 102 moves in a horizontal plane in the direction shown by the arrow in the drawing, whereby internal support mechanism 100 moves into position opposite the central opening 24 of disk shaped support plate 22.

Step 5

Figure 17:
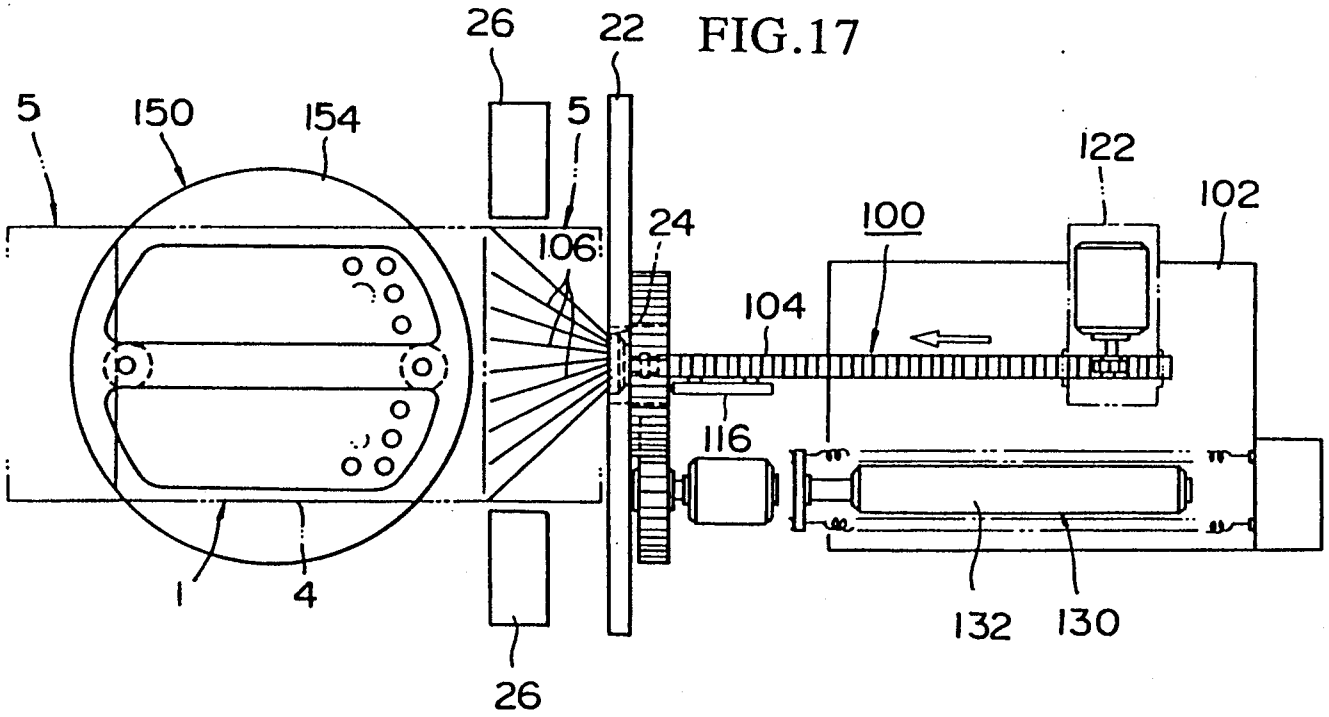
FIG. 17 is an overhead view showing the operation of the crimping apparatus shown in FIG. 3.

Next, as shown in FIG. 17, rack rod driver mechanism 122 of disk shaped support plate 22 is caused to drive rack rod 104 in the direction shown by the arrow in the drawing, and the distal ends of the array of support spokes 106 move through central opening 24 of disk shaped support plate 22 and into the interior of the cylindrical extended portion 5 of wrapping paper 4 projecting beyond the end surface 2 of cylindrical object 1, after which point support spoke drive air cylinder 116 is caused to operate, and the twelve support spokes 106 open similar to the opening of an umbrella.

Figure 18:
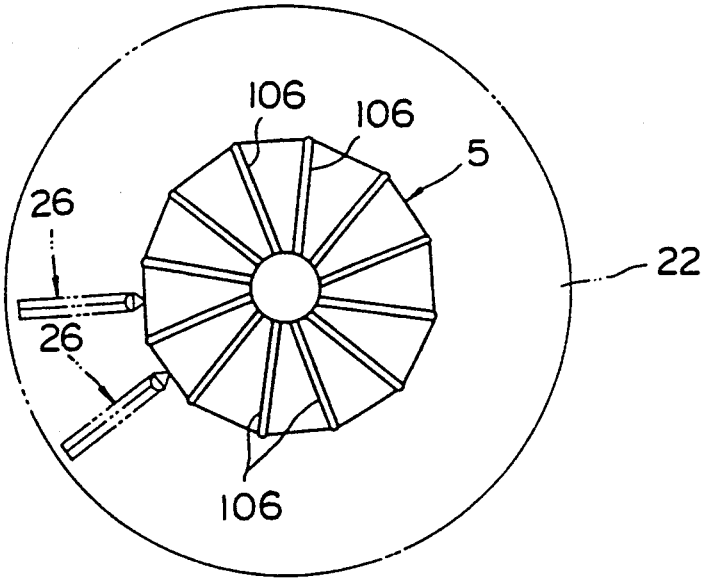
FIG. 18 is a plan view showing the operation of the paper folding mechanism shown in FIG. 4.

The array of support spokes 106 thus opening as described above, their terminal ends come into contact with the internal surface of the cylindrical extended portion 5 of wrapping paper 4 along its circumference. Thus buttressed from within along its circumference, the extended portion 5 of wrapping paper 4 is transformed from a cylindrical configuration, to a configuration approaching that of a regular dodecadron (refer to FIG. 18). At this point, as shown in FIG. 18, the twelve movable plates 26 are positioned in an array radiating outward from the external surface of the extended portion 5 of wrapping paper 4 along its circumference, each movable plate 26 coming into contact with the external surface of extended portion 5 at a position approximately midway between where a respective pair of support spokes 106 come into contact with the internal surface of extended portion 5. In this state, the previously described application force maintenance device 120 (FIG. 11) comes into operation, whereby the force applied outward by the support spokes 106 is maintained at a constant value (3.5 kg/cm$^2$ in the present preferred embodiment).

Step 6

Figure 19:
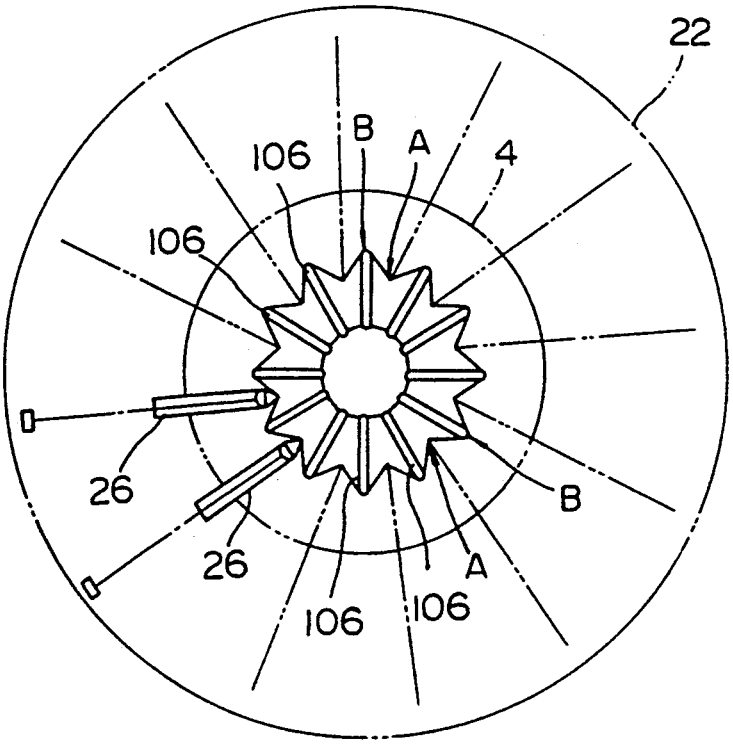
FIG. 19 is a plan view showing the operation of the paper folding mechanism shown in FIG. 4.
Figure 20:
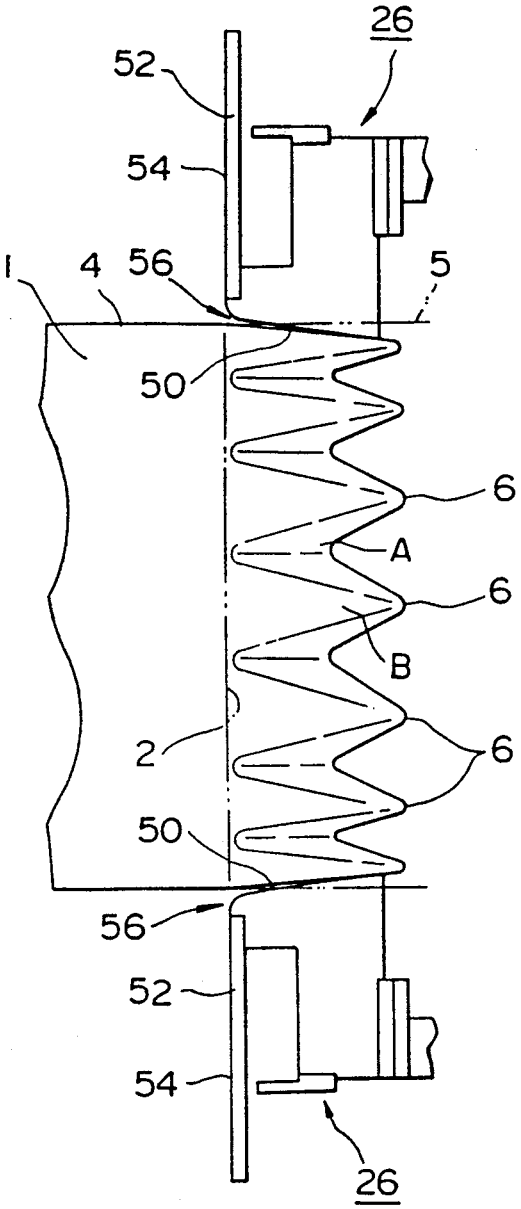
FIG. 20 is a side view showing the operation of the paper folding mechanism shown in FIG. 4.
Figure 21:
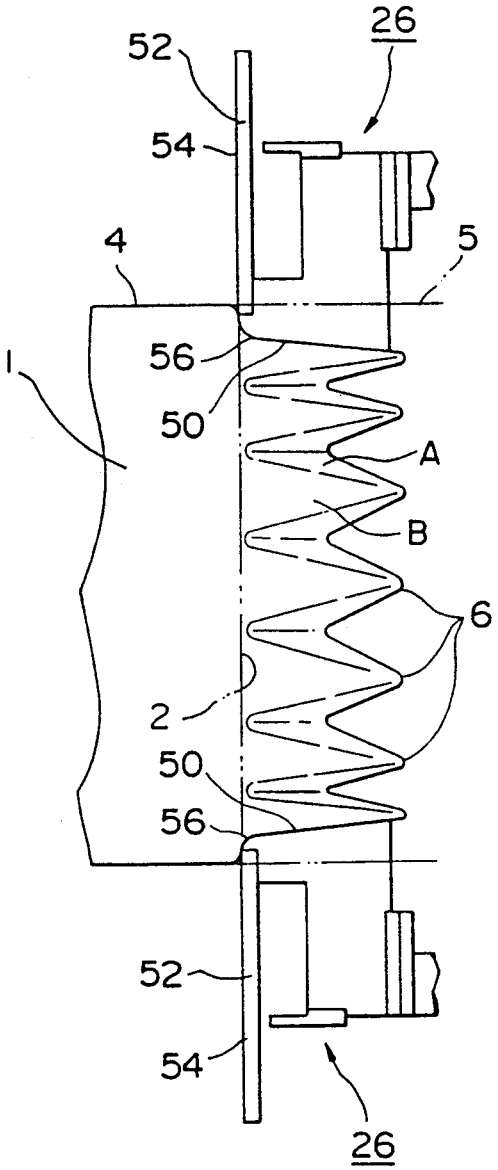
FIG. 21 is a side view showing the operation of the paper folding mechanism shown in FIG. 4.
Figure 22:
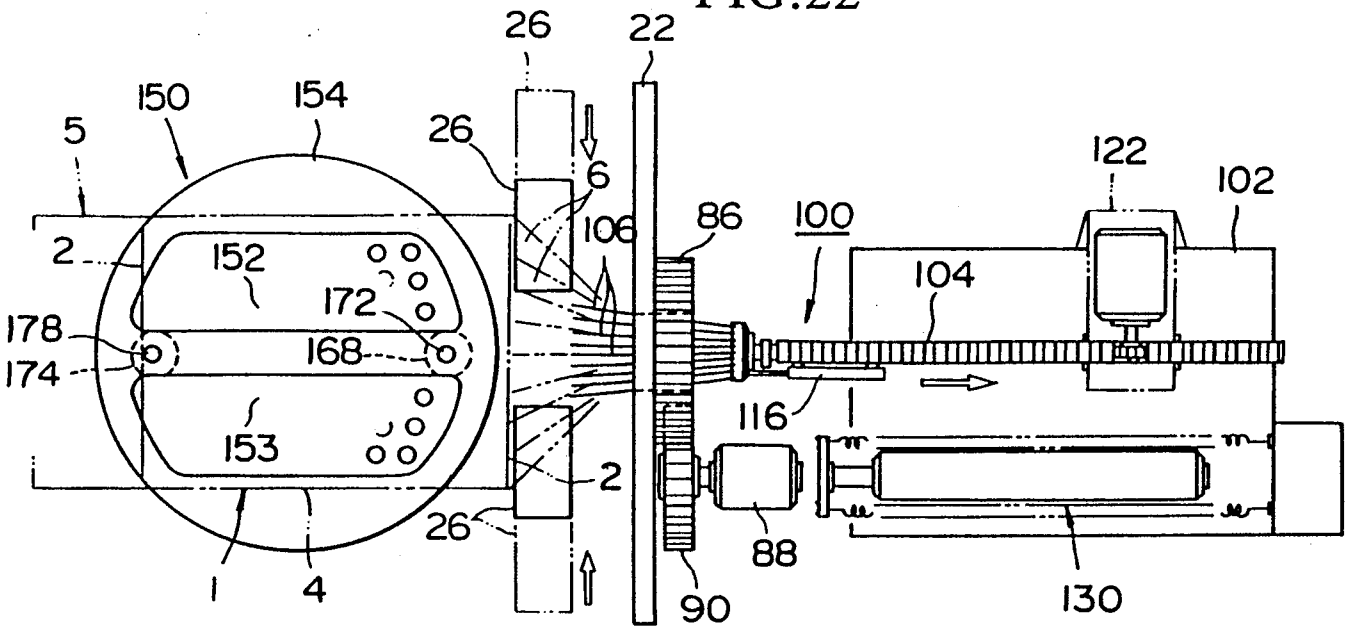
FIG. 22 is an overhead view showing the operation of the crimping apparatus shown in FIG. 3.
Figure 23:
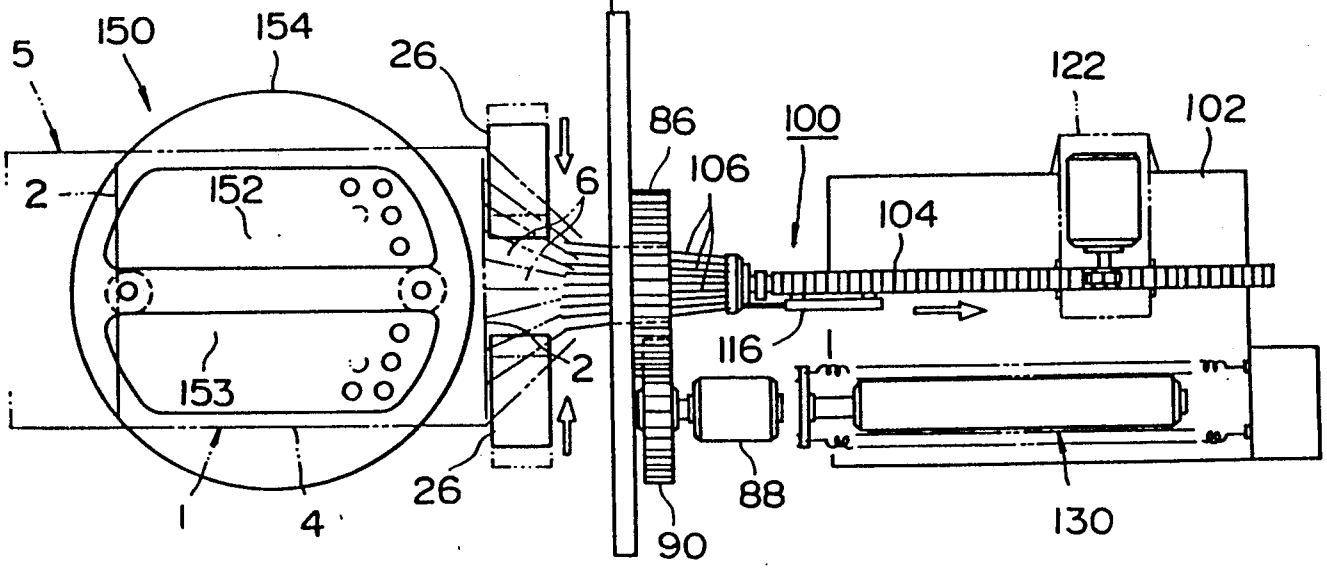
FIG. 23 is an overhead view showing the operation of the crimping apparatus shown in FIG. 3.

The crimping apparatus 200 having reached the state as described in the previous paragraph, next as shown in FIG. 19, the movable plates 26 all move in a central direction simultaneously. In order to effect this simultaneous movement of the movable plates 26, the previously described servo motors 40 shown in FIG. 4 are employed. Through the operation of these servo motors 40, via timing pulleys 42, the respective ball screws 34 are caused to rotate. Because each movable base seat 46 is threaded over a corresponding ball screw 34, the rotation of the ball screws 34 cause the corresponding movable base seats 46 to advance, guided over respective guide rods 32. Through this effect, the twelve movable base seats 46, and hence their respective movable plates 26, are guided in a direction parallel to the axial direction of their respective ball screws 34 and guide rods 32, thus moving centrally with respect to disk shaped support plate 22.

As described and as shown in FIG. 19, the twelve support spokes 106 and twelve movable plates 26 alternate about the circumference of the extended portion 5 at equally spaced intervals, the support spokes 106 being in contact with the inner surface of the extended portion 5 and the movable plates 26 being in contact with the outer surface of the extended portion 5. Thus, while each movable plate 26 forms a respective valley portion A as it moves centrally, the pair of support spokes 106 located at either side of and equally spaced from the respective movable plate 26 form respective apex portions B, through which effect the folded peaks 6 are created, the form of which is shown in detail in FIGS. 20 and 21, in which figures the support spokes 106 are not shown.

As the movable plates 26 move centrally together with their respective valley portions A, the array of support spokes 106 and their respective apex portions B tend to be gradually drawn inward. Further, as the support spokes 106 are thus drawn inward secondary to the central movement of the twelve movable plates 26, the support spokes 106 are simultaneously retracted rearward (refer to FIGS. 22 and 23).

In the present preferred embodiment as thus described, the outward force applied by the support spokes 106 against the inner surface of the extended portion 5 is held constant at a fixed value through the effect of the previously mentioned application force maintenance device 120 (FIG. 11). Accordingly, as the extended portion 5 contracts inward through the action of the inward movement of the movable plates 26, the support spokes 106 apply a constant, fixed, outward directed force to their respective apex portions B, which is 3.5 kg/cm$^2$ in the case of the present preferred embodiment.

Figure 24:
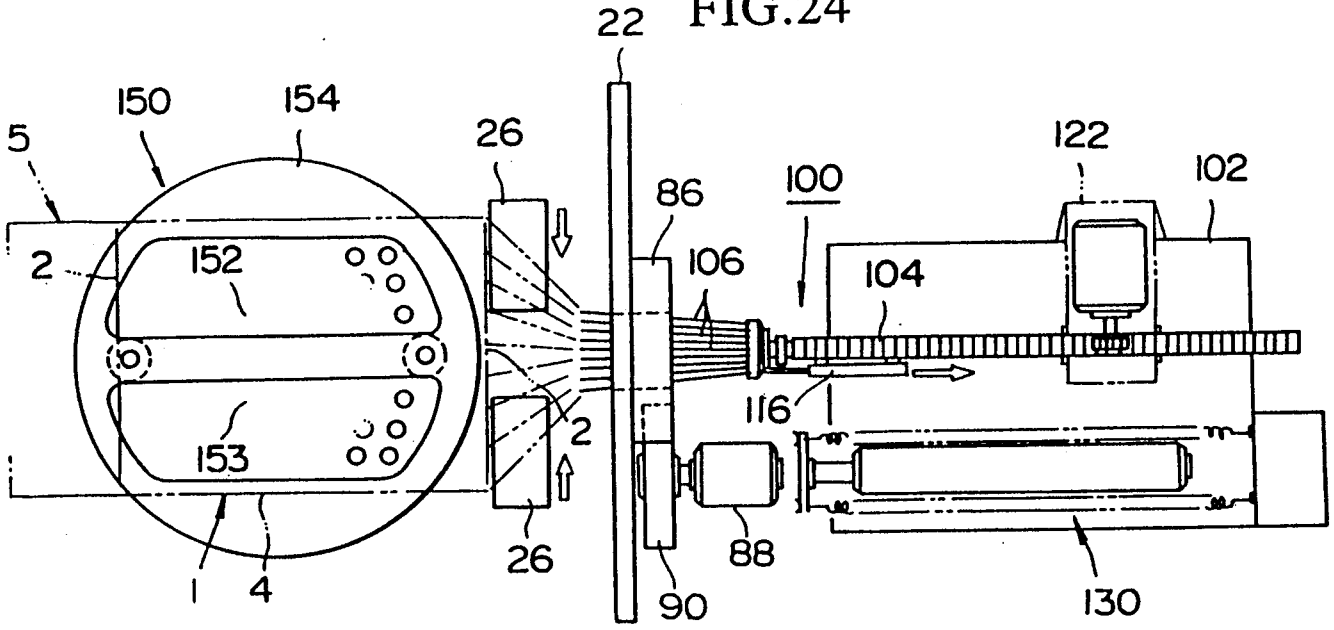
FIG. 24 is an overhead view showing the operation of the crimping apparatus shown in FIG. 3.
Figure 25:
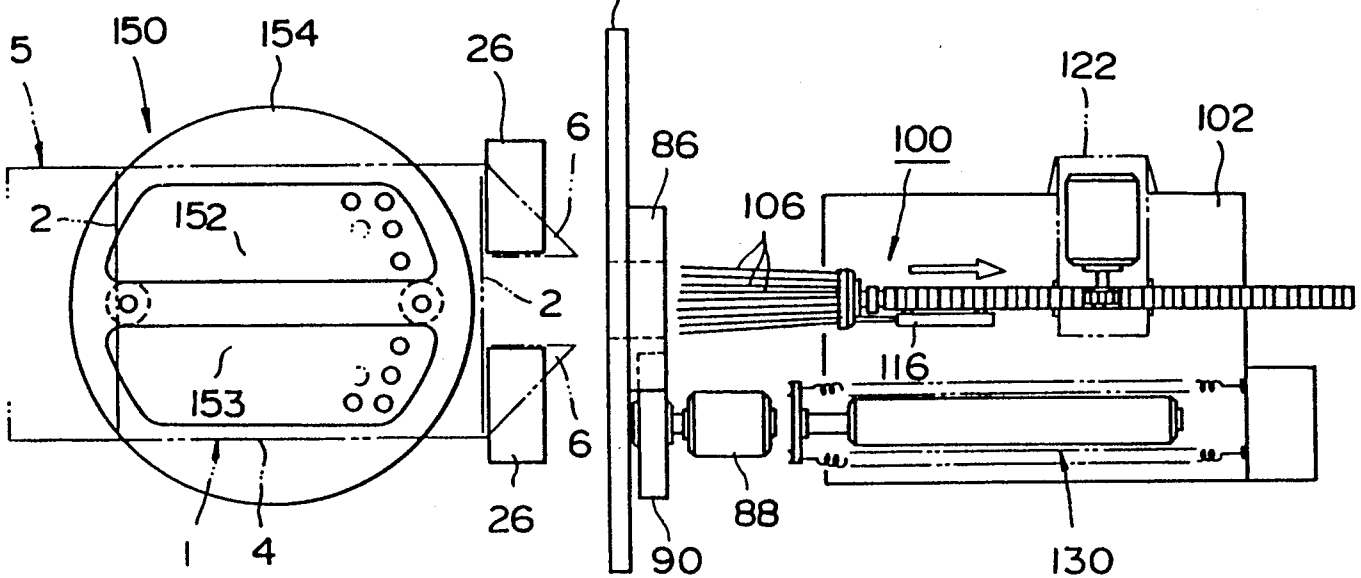
FIG. 25 is an overhead view showing the operation of the crimping apparatus shown in FIG. 3.

Further, in the present preferred embodiment, due to the previously mentioned control means 124, the rearward directed retraction of the array of support spokes 106 is controlled based on and simultaneous with the central movement of the movable plates 26. Supposing that it requires T seconds for the movable plates 26 to move from their peripheral most position to their central most position with respect to disk shaped support plate 22, at the point in time given by (T−a) seconds, the array of support spokes 106 is controlled so as to completely close instantaneously (FIG. 24). While the movable plates are moving centrally, simultaneously, the support spokes 106 begin to collapse and retract. When the movable plates 26 come into contact with the outer surface of the extended portion 5 of the wrapping paper 4, the diameter described by the support spokes 106 decreases while the support spokes 106 apply a constant outward force to the inner surface of the extended portion 5 (and the retraction of the support spokes 106 continues). As mentioned above, at the position reached a seconds prior to when the movable plates 26 stop at their central most position (0.5–2 seconds in the present preferred embodiment), the array of support spokes 106 completely close instantaneously, while at the same time, retract at high velocity from within the extended portion 5 of the wrapping paper 4 (FIG. 25). By controlling the closing and retraction operation of the array of support spokes 106 in this way so that the closing and retraction operation of the support spokes 106 is completed just before the movable plates 26 reach their central most position, it is possible to reliably eliminate any interference between the valley portions A of the folded peaks 6 and the support spokes 106. Put another way, by so controlling the closing and retraction of the support spokes 106, it is possible to support the peak portions B of the folded peaks 6 with the support spokes 106 up to just before interference with the support spokes 106 would occur.

Moreover, because each support spoke 106 opens and closes in an orientation deviating from the radial direction of base end support unit 108 by an angle given by $\theta$, as shown in FIG. 10 and as previously explained, the direction of movement of the support spokes 106 is offset by an angle given by $\theta$ deviating from the radial orientation with respect to extended portion 5 of the wrapping paper 4. Accordingly, because the movement of the movable plates 26 is similarly offset by an angle given by $\theta$ from an exact radial orientation, the paths of the support spokes 106 and those of the movable plates 26 at no time cross and thus contact and interference between the support spokes 106 and those of the movable plates 26 can be prevented (refer to FIGS. 18 and 19).

Step 7

Figure 26:
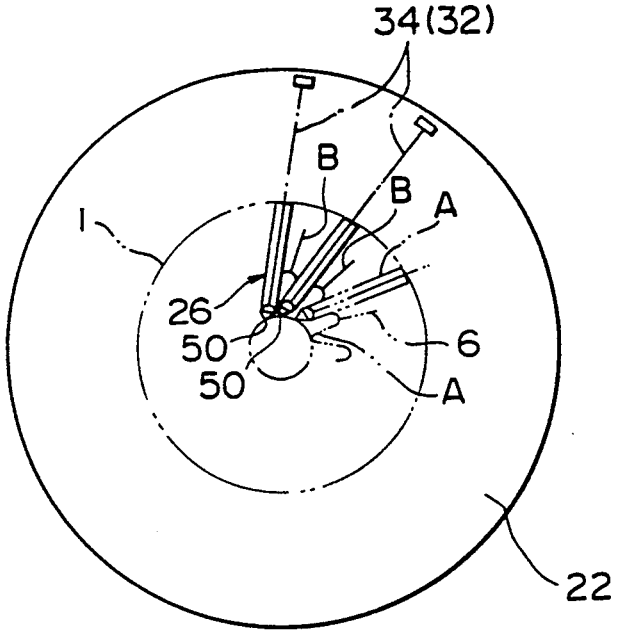
FIG. 26 is a plan view showing the operation of the paper folding mechanism shown in FIG. 4.
Figure 27:
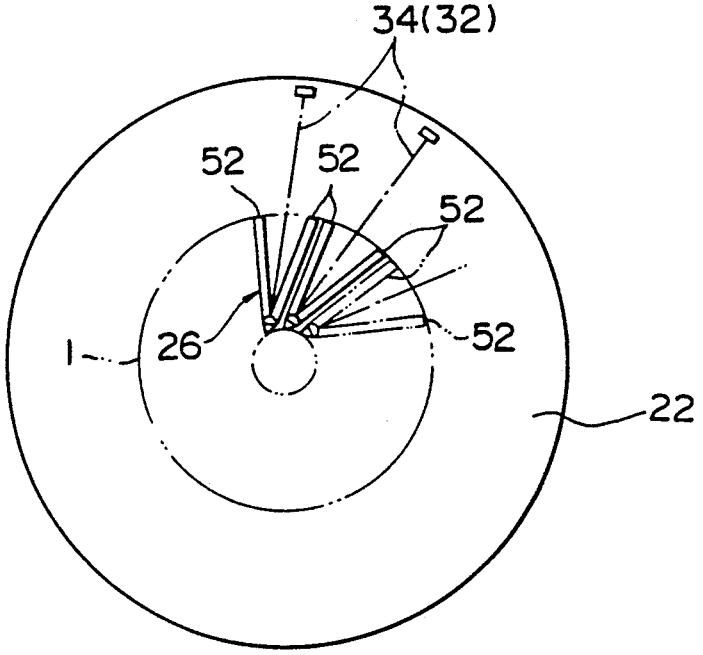
FIG. 27 is a plan view showing the operation of the paper folding mechanism shown in FIG. 4.
Figure 28:
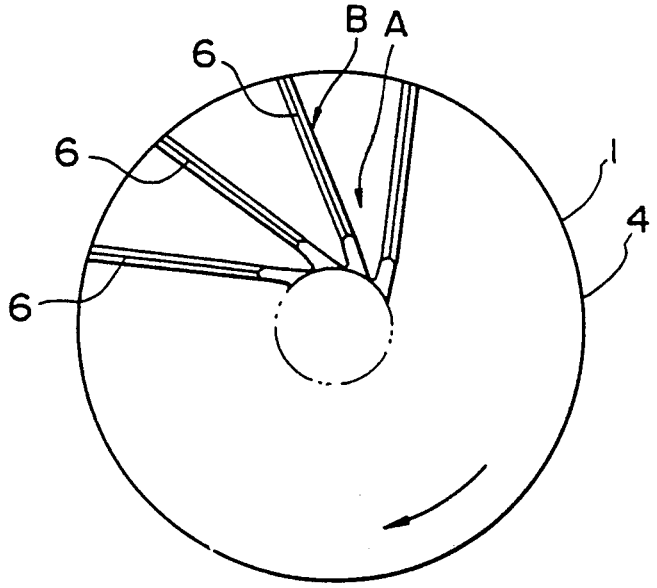
FIG. 28 is a plan view showing the folded peaks formed on a wrapped cylindrical object by the crimping apparatus shown in FIG. 1.

As shown in FIG. 26, as the movable plates 26 move to their central most position, the folding edges 50 of adjacent movable plates 26 approach one another. As the movable plates 26 move centrally with respect to disk shaped support plate 22, the portions of the extended portion 5 of the wrapping paper 4 in contact with the folding edges 50 of the movable plates 26 are folded inward, thereby forming the valley portions A, while at the same time, the portions of the extended portion 5 of the wrapping paper 4 in contact with and supported in a cylindrical configuration by the support spokes 106 are folded outward, thereby forming the peak portions B. Accordingly, the folded peaks 6 in the extended portion 5 of the wrapping paper 4 are thereby formed. Also, because the previously described spreaders 52 provided on the movable plates 26 move into a position approximately parallel with the end surface 2 of the cylindrical object 1 (see FIGS. 20 and 21), the valley portions A of the folded peaks 6 are more or less pushed up against the end surface 2 of the cylindrical object 1 by the movable plates 26.

Step 8

The folded peaks 6 having reached the state described in the preceding paragraph, an air pressure controller not shown in the drawings is brought into operation, whereby pressurized air is supplied to the air cylinders 70 provided on each movable plate 26 (FIG. 5). As the pressurized air is supplied to the air cylinders 70, their respective piston rods 72 extend, whereby as shown in FIG. 7, the two spreaders 52 provided each movable plate 26 pivot about their respective pin 58 and thereby spread into a V-shaped formation. In the present preferred embodiment, each pair of spreaders 52 spread into a V-shaped formation defining an angle of approximately 30°. With the spreaders 52 of each of the twelve movable plates 26 spread into a V-shaped formation as described above, as shown in FIG. 27, neighboring spreaders 52 on adjacent movable plates 26 move into a position so as to be approximately parallel and nearly touching with respect to one another.

The extended portion 5 of the wrapping paper 4 having thus been folded into a corrugated formation of alternating valley portions A and peak portions B with each peak portions B intervening between an adjacent pair of movable plates 26, by the above operation, each peak portion B is clasped between a pair of neighboring spreaders 52 on adjacent movable plates 26. The intervening peak portions B thus pinched between a pair of neighboring spreaders 52 are squeezed so as to approximate a single leaf (refer to FIGS. 28 and 29). However, because the movable plates 26 and support spokes 106 deviate by an angle $\theta$ (10° in the present embodiment) from an exactly radial orientation with respect to disk shaped support plate 22 as described above, the peak portions B compressed between neighboring spreaders 52 similarly deviate by an angle $\theta$ from an exactly radial orientation with respect to disk shaped support plate 22.

Step 9

Next, after having reached the state described in the preceding paragraph, the disk shaped support plate 22, and hence the movable plates 26 mounted thereon are caused to rotate through the operation of the previously described motor 88. By means of the drive gear 90 provided at the end of the drive shaft of motor 88, center gear 86 attached on the rear side of disk shaped support plate 22 surrounding the opening 24 is driven, by which means the disk shaped support plate 22 is caused to rotate as mentioned above.

Figure 30:
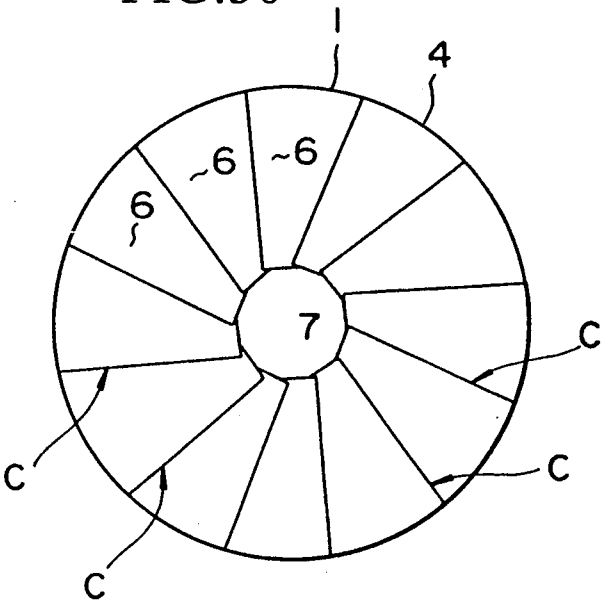
FIG. 30 is a plan view showing the result of the crimping apparatus shown in FIG. 1.
Figure 29:
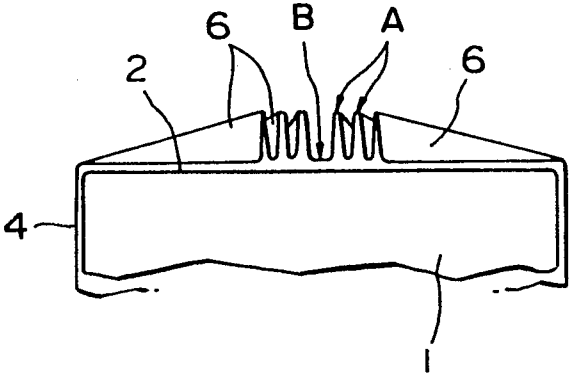
FIG. 29 is a partial side of the folded peaks formed on the wrapped cylindrical object shown in FIG. 28.

As the disk shaped support plate 22 rotates, accompanying the rotation, the twelve folded peaks 6 formed as described above folding against the end surface 2 of the cylindrical object 1 by virtue of the movement of the movable plates 26 (and hence the spreaders 52) relative to the cylindrical object 1, whereby the completed crimped state is achieved as shown in FIG. 30. The direction of rotation of the disk shaped support plate 22 is such that, in consideration of the previously described deviation from an exactly radial orientation of the folded peaks, when the folded peaks are folded against the end surface 2 as described above, the edges formed by the peak portions B come to lie in a position approximating a radial orientation (line C in FIG. 30) with respect to disk shaped support plate 22.

In the present preferred embodiment, because the folded peaks 6 are initially formed at an angle $\theta$ deviating from exactly a radial orientation, and are then folded over so that the apices of the peak portions lie along a radius of the cylindrical object 1, the final product is neat and attractive externally. For the same reasons, the central opening 7 formed by the crimping operation is relatively small, and therefore, a similarly small label may be applied to the central opening.

When the disk shaped support plate 22 is rotating as described above, if after the movable plates 26 have reached their innermost position, they are caused to temporarily reverse and move slightly toward their peripheral position, thereby widening the gap between neighboring spreaders 52, the folded peaks can more smoothly be folded against the end surface 2 of the cylindrical object 1.

Also, even though a measure of the rotational force of the disk shaped support plate 22 is transmitted to the cylindrical object 1, because the cylindrical object 1 is secured by the previously described stopper 172 and the two pressure applying elements 188, no movement of the cylindrical object 1 on the receiving plates 152, 153 occurs.

Step 10

After the gathering process is carried out as described above, as shown in FIG. 31, with the movable plates 26 in their final position (slightly peripheral from the most central position), movable stand 102 is caused to move in a horizontal plane in the direction shown by the arrow in the drawing, whereby once again pressure plate drive mechanism 130 and opening 24 of disk shaped support plate 22 come to be located opposing one another.

Step 11

Through the course of the above described Steps 5–9, a label L is held on the forward surface of pressure plate 136 which is provided at the end of the piston rod 134 of air cylinder 132 of pressure plate drive mechanism 130. Through the action of the previously described vacuum device 144, a vacuum is applied to each of the four suction cups 138 provided on the forward face of pressure plate 136 via respective flexible coiled tubes 142, by which means the above mentioned label L is held in position. Although not shown in the drawings, in the present preferred embodiment, in the proximity of the main crimping unit 210, a label supplying device is provide which stores a quantity of the labels L, and by which means the labels L are automatically supplied, one for each end surface 2 to be crimped, to the suction cups 138 provided on the forward face of pressure plate 136.

Figure 31:
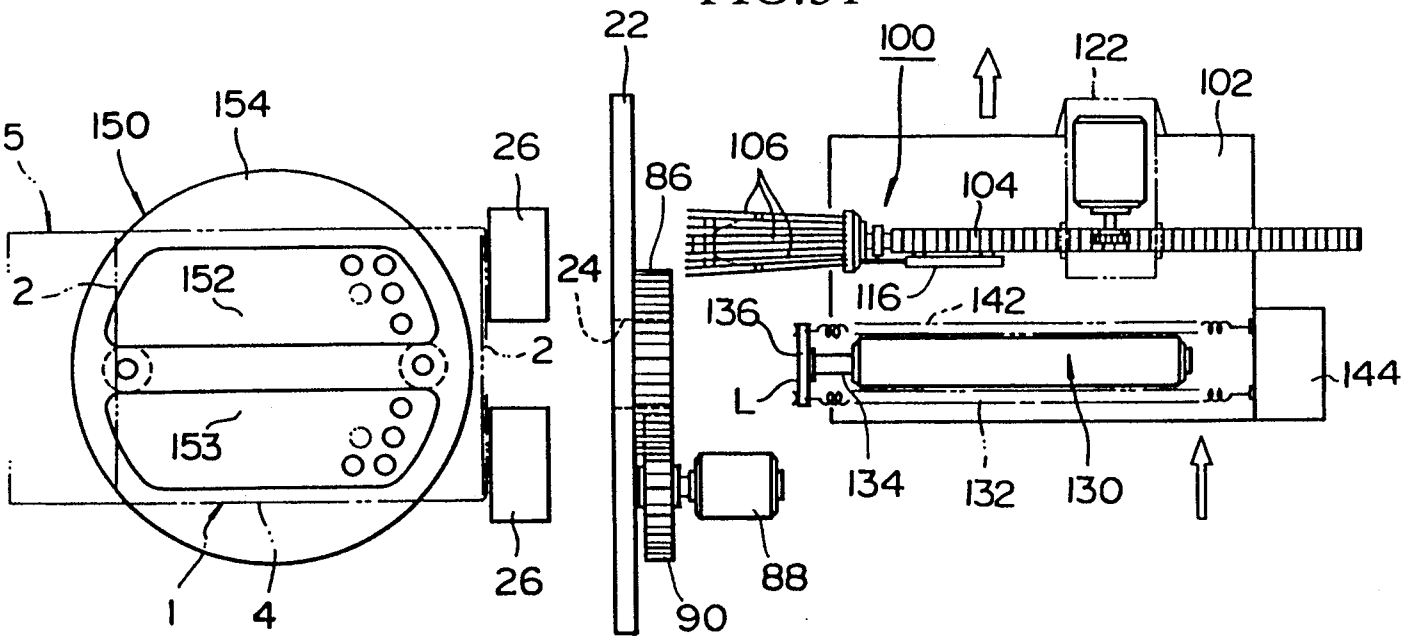
FIG. 31 is an overhead view showing the operation of the crimping apparatus shown in FIG. 3.

Accordingly, the when as shown in FIG. 31, pressure plate drive mechanism 130 and opening 24 of disk shaped support plate 22 come to be located opposed to one another, at the end of Step 10 as described above, a label has already been applied to the suction cups 138 provided on pressure plate 136.

Step 12

Figure 32:
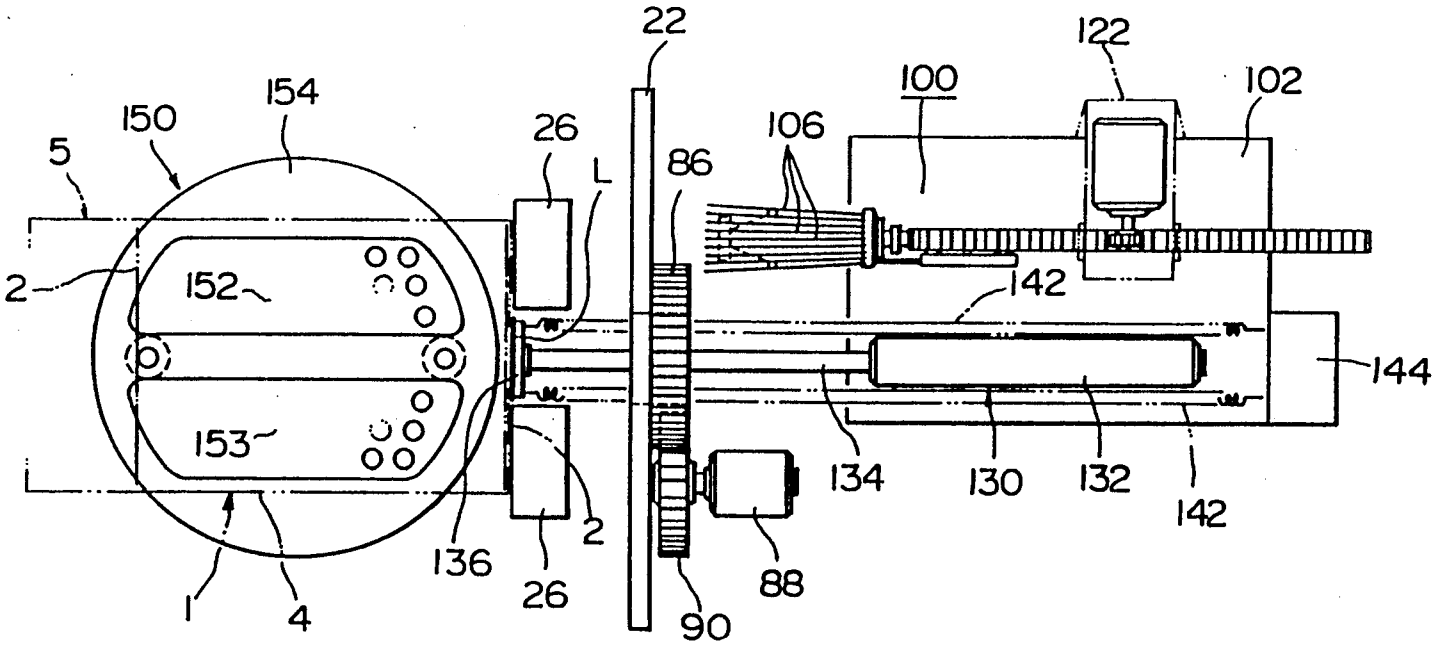
FIG. 32 is an overhead view showing the operation of the crimping apparatus shown in FIG. 3.
Figure 33:
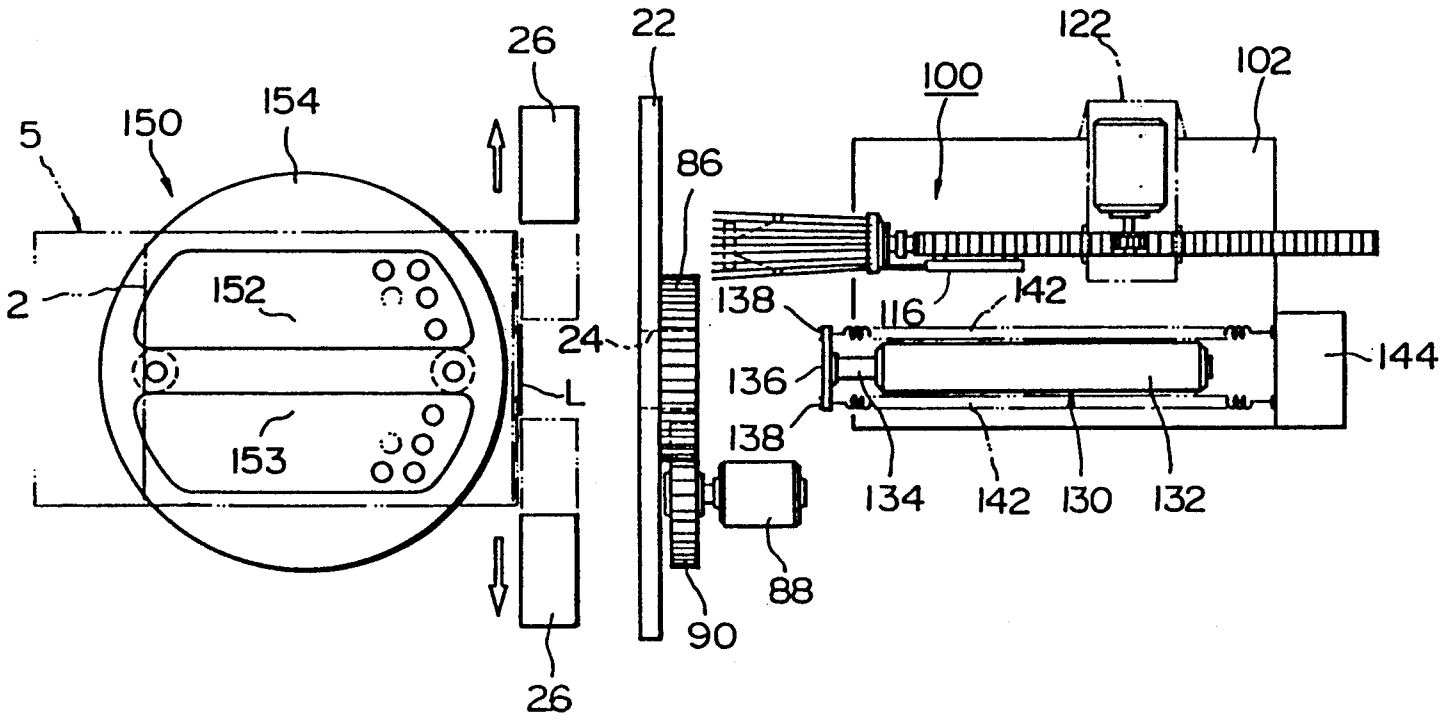
FIG. 33 is an overhead view showing the operation of the crimping apparatus shown in FIG. 3.
Figure 35:
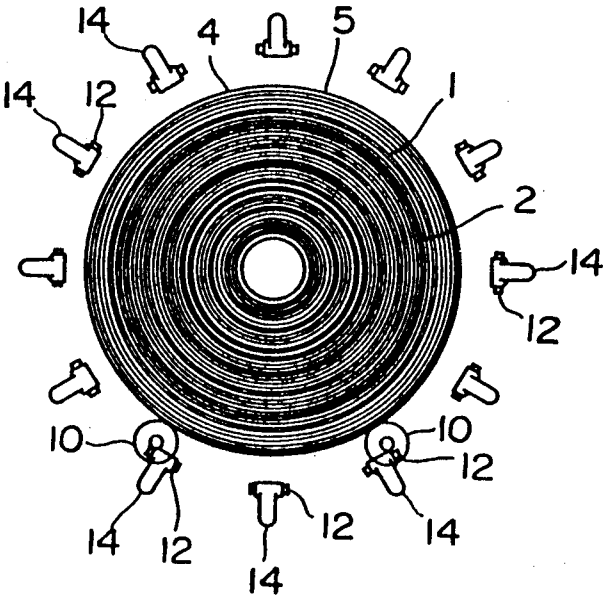
FIG. 35 is a plan view of the prior art crimping apparatus shown in FIG. 34.

As shown in FIG. 32, the piston rod 134 of air cylinder 132 of pressure plate drive mechanism 130 is caused to extend, whereby the label held there by the previously described vacuum is pressed against and thereby fixed over the central opening 7 of the completed crimped extended portion 5 of the wrapping paper 4 which is now folded against the end surface of the cylindrical object 1. Afterwards, the vacuum provided by vacuum device 144 is stopped, and the piston rod 134 of air cylinder 132 retracts, leaving the label affixed over the central opening 7. After completion of the above described label affixing step, as shown in FIG. 33, the movable plates 26 return to their original peripheral position with respect to disk shaped support plate 22, and the spreaders 52 return to their closed (not spread) position.

As described above, after the crimping process is completed and before the label L is attached, the movable plates do not completely retract away from the end surface 2 of the cylindrical object 1. Accordingly, the folded peaks 6 which have been neatly folded against the end surface 2 are not allowed to unfold, or otherwise come undone.

Step 13

At this point, the crimping process has been carried out for one end of the cylindrical object 1 and a label L has been applied to the crimped end. When it is desired to similarly crimp and seal the opposite end, after the cylindrical object 1 is released by the stopper 172 and two pressure applying elements 188, roll support stand 150 is caused to move backwards and the support plate 154 upon which receiving plates 152, 153 are supported is caused to rotate 180° in the horizontal plane, after which Steps 1–12 are repeated as described above.

After both end surfaces 2 of the cylindrical object 1 are crimped and sealed, when the cylindrical object 1 is to be unloaded from roll support stand 150, air cylinder 162 (FIG. 1) is caused to operate, and thereby receiving plate 153 of receiving plates 152, 153 is caused to pivot upward about hinge 158, whereby the cylindrical object 1 is caused to be automatically unloaded from roll support stand 150.

As described above, through crimping apparatus 200, when the folded peaks are formed in the extended portion 5 of the wrapping paper 4 by paper folding mechanism 20 (movable plates 26), the portions which form the peak potions B are supported towards the periphery by the support spokes 106 from prior to onset of the folding operation. Therefore, even when for example the diameter of the cylindrical object 1 is large and the extended portion 5 of the wrapping paper 4 is elongated and prone to drooping, or even if the wrapper paper 4 is thick, a neat and externally attractive crimping operation can reliably be accomplished. Moreover, with the crimping apparatus 200 of the present invention, cylindrical objects 1 of a small diameter, as well as those of a large diameter can be attractively and efficiently wrapped utilizing the same internal support mechanism 100. In the production and packaging of cylindrical objects, for example rolls of paper, because the efficiency of the final wrapping stage can effectively be improved, the throughput of the process as a whole can be improved.

Additionally, particularly with the present preferred embodiment of the crimping apparatus 200 of the present invention, the movable plates 26 are provided so as to move in a direction deviating from exactly a radial path with respect to the cylindrical object 1, and accordingly, the folded peaks 6 are similarly formed deviating from exactly a radial path. Thus, when the folded peaks 6 are folded in against the end surface 2 of the cylindrical object 1, the apex portions B of the folded peaks 6 come to lie in a position approximating the exact radial orientation (line C) with respect to the cylindrical object 1, and hence, further improvements to the external appearance of the crimped end is added, and the size of the central opening 7 is decreased allowing use of a smaller sealing label L.

Moreover, by provision of the spreaders 52, after formation of the folded peaks 6 in the extended portion 5 of the wrapping paper 4, each folded peak is clasped between two neighboring spreaders 52 as each spreader 52 extends into a V-formation. Accordingly, the folded peaks are compressed to approximate a single leaf formation which can neatly and readily be folded in against the end surface 2 of the cylindrical object 1 by the simultaneous rotation of the disk shaped support plate 22 (and hence the movable plates 26) and the central motion of the movable plates 26.

Figure 34:
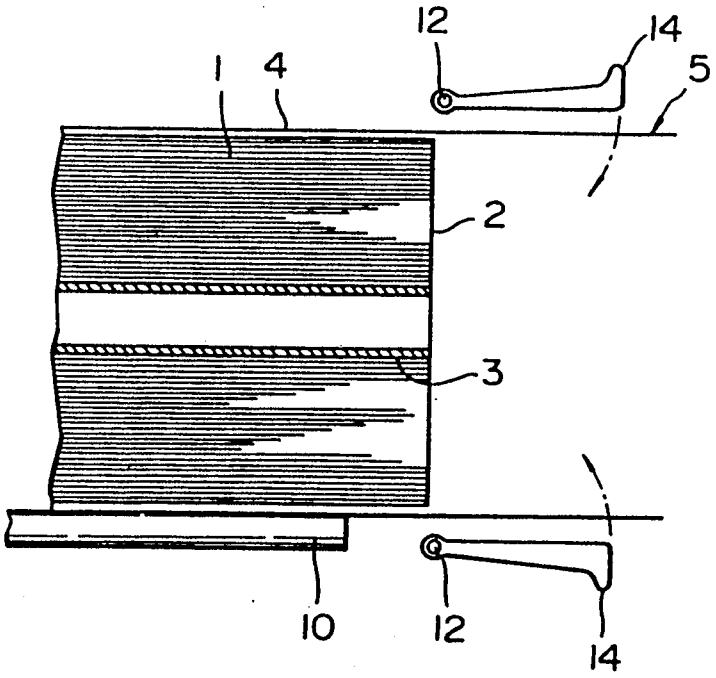
FIG. 34 is a partial side view showing an example of a prior art crimping apparatus.
Figure 37:
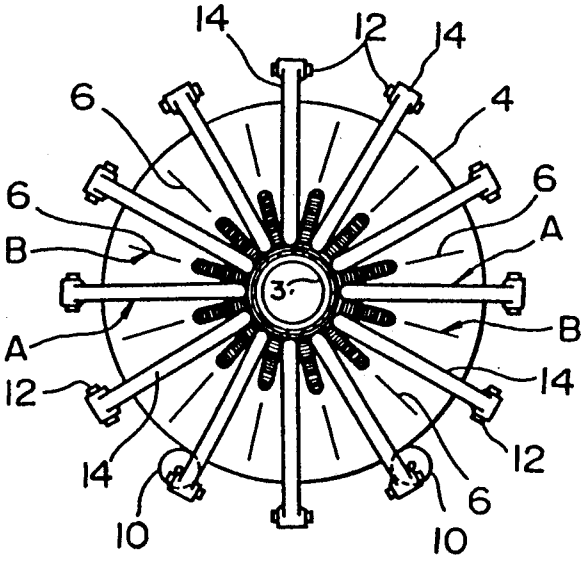
FIG. 37 is a plan view of the prior art crimping apparatus shown in FIG. 36.
Figure 36:
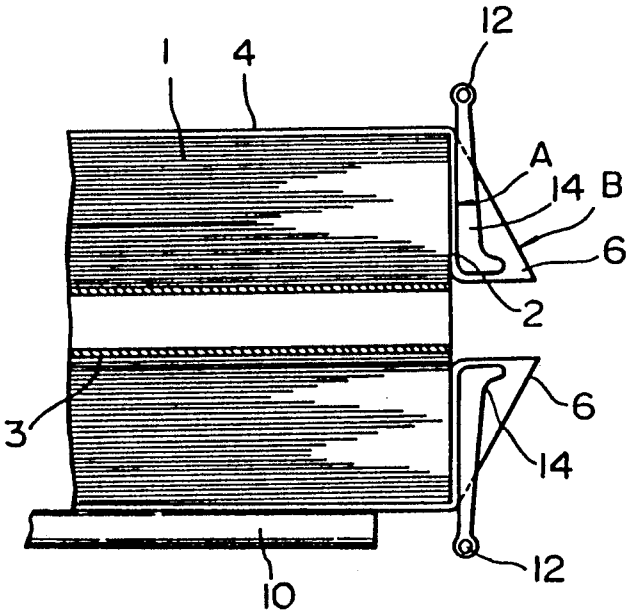
FIG. 36 is a side view showing the operation of the prior art crimping apparatus shown in FIG. 34.
Figure 38:
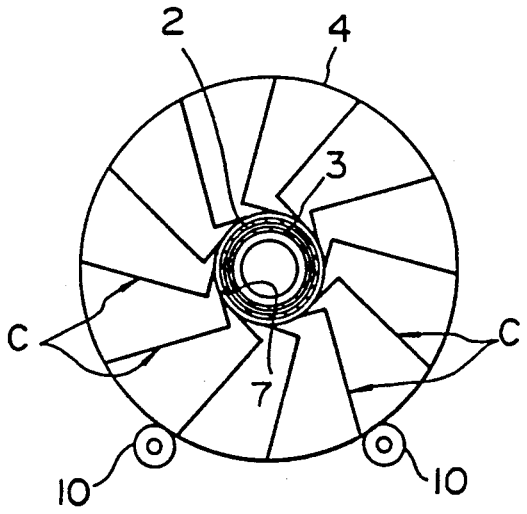
FIG. 38 is a plan view showing the result of the crimping apparatus shown in FIG. 34.

In the case of the present invention, the internal support of the peak sections B of the folded peaks 6 achieved with the internal support apparatus 100, can be achieved when employing a paper folding mechanism 20 different than that described for the present preferred embodiment, for instance, one similar to that shown for the prior art device in FIG. 34.

Also, while with the present preferred embodiment, only one end of the cylindrical object 1 is crimped at one time, it is possible to provide an internal support apparatus 100 and folding mechanism 20 at both ends of the cylindrical object 1 and thereby carry out crimping at both ends simultaneously.

What is claimed is:

1. A crimping apparatus used for crimping at least one end of a sheet form wrapping material applied around a cylindrical object, wherein said cylindrical object defines an outer peripheral surface of circular cross section, two end surfaces, and a longitudinal axis parallel to said outer peripheral surface, the wrapping material being wrapped around the outer peripheral surface of the cylindrical object in such a manner as to extend beyond at least one end surface of the cylindrical object, thereby forming at least one extension of the wrapping material, the crimping apparatus including a sheet folding mechanism comprising:

(a) a plurality of movable plates disposed in a ring formation such that when said cylindrical object is moved into position for crimping of said at least one extension of the wrapping material, said plurality of movable plates are disposed circumferentially around said at least one extension of the wrapping material with each movable plate oriented approximately radially with respect to the extension of the wrapping material, each of the movable plates being of an elongated shape a lengthwise direction of which is disposed approximately along the radial direction of the cylindrical object, said plurality of movable plates being movable centrally in unison in approximately a radial direction in only a plane parallel to said end surface of said cylindrical object, whereby said at least one extension of the wrapping material, is folded inward and against the respective end surface of the cylindrical object along each line where each movable plate comes into contact with said extension of the wrapping material thereby creating a plurality of folds in said extension of the wrapping material;

(b) a rotating means for rotating said plurality of movable plates in unison in a plane parallel to said end surface of said cylindrical object, thereby flattening said plurality of folds and causing said plurality of folds to fold flush against said end surface;

wherein said movable plates each comprise a folding edge oriented approximately parallel to said extension of the wrapping material prior to crimping, said folding edges coming into contact with the outer peripheral surface of said extension of the wrapping material when said plurality of movable plates move centrally in unison, each of said movable plates further comprising a pair of spreaders oriented approximately parallel to said end surface of the cylindrical object, and moving substantially parallel and adjacent to said end surface of the cylindrical object, each spreader of said pair of spreaders including a pivot joint at the end of said spreader closest to said folding edge of said movable plate, whereby each spreader can open in a manner analogous to the opening of scissors, said opening of said pair of spreaders occurring approximately in a plane parallel to said end face of said cylindrical object while said movable plate is moving centrally, whereby adjacent spreaders on adjacent movable plates move into an approximately parallel, adjacent relationship, thereby compressing one of said plurality of folds into an approximately flat configuration.

2. A crimping apparatus used for crimping at least one end of a sheet form wrapping material applied around a cylindrical object, wherein said cylindrical object defines an outer peripheral surface of circular cross section, two end surfaces, and a longitudinal axis parallel to said outer peripheral surface, the wrapping material being wrapped around the outer peripheral surface of the cylindrical object in such a manner as to extend beyond at least one end surface of the cylindrical object, thereby forming at least one extension of the wrapping material, the crimping apparatus including a sheet folding mechanism whereby said at least one extension of the wrapping material is folded inward and against the respective end surface of the cylindrical object thereby creating a plurality of folds in said extension of the wrapping material, said crimping apparatus further including an internal support apparatus comprising:

(a) a radial array of internal supporting members defining a central axis, provided so as to be movable in unison along a line parallel to said longitudinal axis of said cylindrical body, in such a position that when said cylindrical object is moved into position for crimping of said at least one extension of the wrapping material, said central axis of said radial array of internal supporting members is disposed substantially colinearly with said longitudinal axis of said cylindrical object, whereby said radial array of internal supporting members can be moved towards said end surface of said cylindrical object, whereby said radial array of internal supporting members come to be located internal and substantially parallel to said at least one extension of the wrapping material;

(b) an internal support apparatus driving mechanism by which means said radial array of internal supporting members can be caused to expand circumferentially, each internal supporting member moving outward in approximately a radial direction, thereby coming into contact with the internal surface defined by said at least one extension of the wrapping material;

wherein each of the internal supporting members comprises a support spoke of an elongated linear shape, the support spoke being pivotally attached to the internal support apparatus driving mechanism, each of the support spokes having a distal end located between its pivotal attachment to the support apparatus and the cylindrical object which end is movable generally along a radial line of the cylindrical object, the distal end being disposed radially outward of the rest of the support spoke relative to the cylindrical object whereby said spoke is inclined outwardly and toward said end surface of said cylindrical object so that the distal ends of the support spokes can come into contact with the internal surface defined by the extension of the wrapping material, and whereby the internal surface of said at least one extension of the wrapping material is supported from within during at least part of the time when said paper folding mechanism causes said at least one extension of the wrapping material to be folded inward and against the respective end surface of the cylindrical object, by which means a plurality of folds are formed in said extension of the wrapping material, said plurality of folds defining of a plurality of peak sections and valley sections, wherein said peak sections are those sections of the extension of the wrapping material immediately adjacent to and supported from within by one of said internal supporting members, and said valley sections are those sections of the extension of the wrapping material in contact with said paper folding mechanism and thereby folded inward and against the respective end surface of the cylindrical object.

3. A crimping apparatus used for crimping at least one end of a sheet form wrapping material applied around a cylindrical object, wherein said cylindrical object defines an outer peripheral surface of circular cross section, two end surfaces, and a longitudinal axis parallel to said outer peripheral surface, the wrapping material being wrapped around the outer peripheral surface of the cylindrical object in such a manner as to extend beyond at least one end surface of the cylindrical object, thereby forming at least one extension of the wrapping material, the crimping apparatus including a paper folding mechanism comprising:

(a) a plurality of movable plates disposed in a ring formation such that when said cylindrical object is moved into position for crimping of said at least one extension of the wrapping material, said plurality of movable plates are disposed circumferentially around said at least one extension of the wrapping material with each movable plate oriented approximately radially with respect to the extension of the wrapping material, each of the movable plates being of an elongated shape a lengthwise direction of which is disposed approximately along the radial direction of the cylindrical object, said plurality of movable plates being movable centrally in unison in approximately a radial direction in only a plane parallel to said end surface of said cylindrical object, whereby said at least one extension of the wrapping material is folded inward and against the respective end surface of the cylindrical object along each line where each movable plate comes into contact with said extension of the wrapping material, thereby creating a plurality of folds in said extension of the wrapping material; and (b) a rotating means for rotating said plurality of movable plates in unison in a plane parallel to said end surface of said cylindrical object, thereby flattening said plurality of folds and causing said plurality of folds to fold flush against said end surface, and the crimping apparatus further including an internal support apparatus comprising:

(a) a radial array of internal supporting members defining a central axis, provided so as to be movable in unison along a line parallel to said longitudinal axis of said cylindrical body, in such a position that when said cylindrical object is moved into position for crimping of said at least one extension of the wrapping material, said central axis of said radial array of internal supporting members is disposed substantially colinearly with said longitudinal axis of said cylindrical object, whereby said radial array of internal supporting members can be moved towards said end surface of said cylindrical object, whereby said radial array of internal supporting members come to be located internal and substantially parallel to said at least one extension of the wrapping material;

(b) an internal support apparatus driving mechanism by which means said radial array of internal supporting members can be caused to expand circumferentially, each internal supporting member moving outward in approximately a radial direction, thereby coming into contact with the internal surface defined by said at least one extension of the wrapping material;

wherein each of the internal supporting members comprises a support spoke of an elongated linear shape, the support spoke being pivotally attached to the internal support apparatus driving mechanism, each of the support spokes having a distal end located between its pivotal attachment to the support apparatus and the cylindrical object which end is movable generally along a radial line of the cylindrical object, the distal end being disposed radially outward of the rest of the support spoke relative to the cylindrical object whereby said spoke is inclined outwardly and toward said end surface of said cylindrical object so that the distal ends of the support spokes can come into contact with the internal surface defined by the extension of the wrapping material, and whereby the internal surface of said at least one extension of the wrapping material is supported from within during at least part of the time when said movable plates of said paper folding mechanism cause said at least one extension of the wrapping material to be folded inward and against the respective end surface of the cylindrical object, by which means a plurality of folds are formed in said extension of the wrapping material, said plurality of folds defining a plurality of peak sections and valley sections, wherein said peak sections are those sections of the extension of the wrapping material immediately adjacent to and supported from within by one of said internal supporting members, and said valley sections are those sections of the extension of the wrapping material immediately adjacent to and compressed internally from without by one of said movable plates of said paper folding mechanism and thereby folded inward and against the respective end surface of the cylindrical object.

4. A crimping apparatus in accordance with claim 1 above, in which said plurality of movable plates are disposed circumferentially around said at least one extension of the wrapping material with each movable plate oriented at an angle deviating from a radial orientation with respect to the extension of the wrapping material, said plurality of movable plates being movable centrally in unison at said angle deviating from a radial orientation.

5. A crimping apparatus in accordance with claim 3 above, in which said radial array of internal supporting members are caused to expand circumferentially with each internal supporting member moving outward at an angle deviating from a radial orientation with respect to the extension of the wrapping material, thereby coming into contact with the internal surface defined by said at least one extension of the wrapping material.

6. A crimping apparatus in accordance with claim 3 above, the internal support apparatus further including an application force maintenance device, whereby when said radial array of internal supporting members is in contact with the internal surface defined by said at least one extension of the wrapping material, the outward directed force applied by said radial array of internal supporting members against said internal surface is maintained constant at a fixed value.

7. A crimping apparatus in accordance with claim 3 above, the internal support apparatus including an application force maintenance device, whereby when said radial array of internal supporting members is in contact with the internal surface defined by said at least one extension of the wrapping material, the outward directed force applied by said radial array of internal supporting members against said internal surface is maintained constant at a fixed value, the crimping apparatus further including an internal support apparatus control device whereby the movement of the internal support apparatus in the direction parallel to its central axis, the application force maintained by the application force maintenance device, and the external diameter of the internal support apparatus is controlled based on the movement of said movable plates.

8. A crimping apparatus in accordance with claim 1 above, the crimping apparatus further including a seal application means for applying a seal on the crimped end of the wrapping material folded against the end surface of the cylindrical object, the seal application means being able to be positioned to so as to oppose the end surface of the cylindrical object, the seal application means having a seal holding means for holding a seal, the seal application means being movable generally parallel to the longitudinal axis of the cylindrical object, thereby adhering the seal on the crimped end of the wrapping material against the end face of the cylindrical object, thereby maintaining the crimped end of the wrapping material in its crimped state.

* * * * *

UNITED STATES PATENT AND TRADEMARK OFFICE

CERTIFICATE OF CORRECTION

PATENT NO. : 5,016,430

DATED : May 21, 1991

INVENTOR(S) : Itoh, et. al.

It is certified that error appears in the above-identified patent and that said Letters Patent is hereby corrected as shown below:

TITLE PAGE: Column 1, Item [56] should read--

3,807,132 4/74 Kamiya--

Title Page, column 2, under Foreign Patent Documents add the following references:

-- 1,380,677 10/64 France

55/3212 9/75 Japan

55/3213 12/75 Japan

55/3214 8/75 Japan

55/43971 10/75 Japan

57/30726 9/77 Japan

58/48410 11/75 Japan--

Signed and Sealed this

Fifteenth Day of December, 1992

*Attest:*

DOUGLAS B. COMER

*Attesting Officer*

*Acting Commissioner of Patents and Trademarks*